US010181315B2

(12) United States Patent
Alderson et al.

(10) Patent No.: US 10,181,315 B2
(45) Date of Patent: Jan. 15, 2019

(54) SYSTEMS AND METHODS FOR SELECTIVELY ENABLING AND DISABLING ADAPTATION OF AN ADAPTIVE NOISE CANCELLATION SYSTEM

(71) Applicant: Cirrus Logic, Inc., Austin, TX (US)

(72) Inventors: Jeffrey D. Alderson, Austin, TX (US); Jon D. Hendrix, Wimberley, TX (US); Dayong Zhou, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 108 days.

(21) Appl. No.: 14/304,208

(22) Filed: Jun. 13, 2014

(65) Prior Publication Data

US 2015/0365761 A1 Dec. 17, 2015

(51) Int. Cl.
*G10K 11/178* (2006.01)
*H04R 1/10* (2006.01)
(Continued)

(52) U.S. Cl.
CPC ..... *G10K 11/178* (2013.01); *G10K 11/1784* (2013.01); *H04R 1/1083* (2013.01);
(Continued)

(58) Field of Classification Search
CPC ... G10K 2210/3045; G10K 2210/3017; G10K 11/1784; G10K 11/1782; G10K 2210/108;
(Continued)

(56) References Cited

U.S. PATENT DOCUMENTS 5,010,401 A * 4/1991 Murakami ..... G06T 9/008 375/240.16
5,117,401 A * 5/1992 Feintuch ..... G10K 11/1784 367/1
(Continued)

FOREIGN PATENT DOCUMENTS

DE 102011013343 A1 9/2012
EP 0412902 A2 2/1991
(Continued)

OTHER PUBLICATIONS

Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
(Continued)

*Primary Examiner* — Yogeshkumar Patel
(74) *Attorney, Agent, or Firm* — Jackson Walker L.L.P.

(57) ABSTRACT

In accordance with the present disclosure, an adaptive noise cancellation system may include a controller. The controller may be configured to determine a degree of convergence of an adaptive coefficient control block for controlling an adaptive response of the adaptive noise cancellation system. The controller may enable adaptation of the adaptive coefficient control block if the degree of convergence of the adaptive response is below a particular threshold and disable adaptation of the adaptive coefficient control block if the degree of convergence of the adaptive response is above a
(Continued)

particular threshold, such that when the adaptive noise cancellation system is adequately converged, the adaptive noise cancellation system may conserve power by disabling one or more of its components.

40 Claims, 10 Drawing Sheets

(51) Int. Cl.
*H04R 3/00* (2006.01)
*H04R 5/033* (2006.01)

(52) U.S. Cl.
CPC ..... *H04R 3/005* (2013.01); *G10K 2210/1081* (2013.01); *G10K 2210/3016* (2013.01); *G10K 2210/3026* (2013.01); *G10K 2210/3028* (2013.01); *G10K 2210/3045* (2013.01); *H04R 5/033* (2013.01); *H04R 2410/05* (2013.01); *H04R 2499/11* (2013.01)

(58) Field of Classification Search
CPC ..... G10K 2210/51; G10K 11/178; G10K 2210/1081; G10K 2210/3016; G10K 2210/3026; G10K 2210/3028; G10L 2021/02166; G10L 21/0208; G10L 2025/783; H04R 2460/03; H04R 1/1083; H04R 2410/05; H04R 3/005; H04R 5/033; H04R 2499/11
USPC ..... 381/71.11, 71.1, 94.1, 94.7, 57; 455/550.1; 704/210, E11.007
See application file for complete search history.

(56) References Cited

U.S. PATENT DOCUMENTS 5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,559,893 A 9/1996 Krokstad
RE35,414 E * 12/1996 Murakami ..... G06T 9/008 348/420.1
5,586,190 A 12/1996 Trantow et al.
5,640,450 A 6/1997 Watanabe
5,668,747 A * 9/1997 Ohashi ..... G06F 17/10 708/322
5,696,831 A 12/1997 Inanga
5,699,437 A 12/1997 Finn
5,706,344 A 1/1998 Finn
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,970,092 A * 10/1999 Currivan ..... H04L 25/03038 375/232
5,978,473 A * 11/1999 Rasmusson ..... H03H 21/0012 379/406.08
5,991,418 A 11/1999 Kuo
6,041,126 A 3/2000 Terai et al.
6,118,878 A 9/2000 Jones
6,185,300 B1 2/2001 Romesburg
6,219,427 B1 4/2001 Kates et al.
6,278,786 B1 8/2001 McIntosh
6,282,176 B1 8/2001 Hemkumar
6,317,501 B1 11/2001 Matsuo
6,381,272 B1 * 4/2002 Ali ..... H03H 21/0012 370/291
6,415,247 B1 * 7/2002 Kimura ..... G06K 9/00496 370/290
6,418,228 B1 7/2002 Terai et al.
6,434,110 B1 * 8/2002 Hemkumar ..... H04M 9/082 370/201
6,434,246 B1 8/2002 Kates et al.
6,434,247 B1 8/2002 Kates et al.
6,522,746 B1 2/2003 Marchok et al.
6,683,960 B1 1/2004 Fujii et al.
6,728,380 B1 * 4/2004 Zhu ..... H04B 15/02 381/71.1
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,110,864 B2 9/2006 Restrepo et al.
7,181,030 B2 2/2007 Rasmussen et al.
7,330,739 B2 2/2008 Somayajula
7,365,669 B1 4/2008 Melanson
7,368,918 B2 5/2008 Henson et al.
7,441,173 B2 10/2008 Restrepo et al.
7,466,838 B1 12/2008 Moseley
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,107,637 B2 1/2012 Asada et al.
8,165,313 B2 4/2012 Carreras
8,249,262 B2 8/2012 Chua et al.
8,290,537 B2 10/2012 Lee et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,942,976 B2 * 1/2015 Li ..... G10L 21/0208 372/19
8,948,407 B2 2/2015 Alderson et al.
8,958,571 B2 2/2015 Kwatra et al.
8,977,545 B2 3/2015 Zeng et al.
9,066,176 B2 6/2015 Hendrix et al.
9,082,391 B2 * 7/2015 Yermeche ..... G10K 11/1784
9,094,744 B1 7/2015 Lu et al.
9,106,989 B2 8/2015 Li et al.
9,107,010 B2 8/2015 Abdollahzadeh Milani et al.
9,264,808 B2 2/2016 Zhou et al.
9,294,836 B2 3/2016 Zhou et al.
9,301,048 B2 * 3/2016 Sugiyama ..... H04M 9/082
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Czermak et al.
2004/0240677 A1 12/2004 Onishi et al.
2004/0242160 A1 12/2004 Ichikawa et al.
2004/0264706 A1 12/2004 Ray et al.

(56) References Cited

U.S. PATENT DOCUMENTS

2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0055910 A1 3/2006 Lee
2006/0069556 A1 3/2006 Nadjar et al.
2006/0109941 A1 5/2006 Keele, Jr.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0208520 A1 9/2007 Zhang et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0101622 A1* 5/2008 Sugiyama ..... H04M 9/082 381/66
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammed et al.
2008/0240455 A1 10/2008 Inoue et al.
2008/0240457 A1 10/2008 Innoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1* 3/2009 Solbeck ..... H04R 25/453 381/71.6
2009/0086990 A1 4/2009 Christoph
2009/0136057 A1 5/2009 Taenzer
2009/0175466 A1 7/2009 Elko et al.
2009/0196429 A1 8/2009 Ramakrishnan et al.
2009/0202024 A1* 8/2009 Inoue ..... H04B 1/1081 375/347
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Shridhar et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0166206 A1 7/2010 Macours
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0226210 A1 9/2010 Kordis et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Marcel et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.
2010/0322430 A1 12/2010 Isberg
2011/0002468 A1 1/2011 Tanghe
2011/0007907 A1 1/2011 Park et al.
2011/0026724 A1 2/2011 Doclo
2011/0091047 A1 4/2011 Konchitsky et al.
2011/0096933 A1 4/2011 Eastty
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson et al.
2011/0249826 A1 10/2011 Van Leest
2011/0288860 A1 11/2011 Schevciw et al.
2011/0293103 A1* 12/2011 Park ..... G10K 11/1782 381/57
2011/0299695 A1 12/2011 Nicholson
2011/0305347 A1 12/2011 Wurm
2011/0317848 A1 12/2011 Ivanov et al.
2012/0057720 A1* 3/2012 Van Leest ..... G10K 11/178 381/71.11
2012/0084080 A1* 4/2012 Konchitsky ..... G10L 21/0208 704/210
2012/0135787 A1 5/2012 Kusunoki et al.
2012/0140917 A1 6/2012 Nicholson et al.
2012/0140942 A1 6/2012 Loeda
2012/0140943 A1* 6/2012 Hendrix ..... G10K 11/1784 381/71.11
2012/0148062 A1 6/2012 Scarlett et al.
2012/0155666 A1 6/2012 Nair
2012/0163580 A1* 6/2012 Fujita ..... H04M 9/082 379/406.1
2012/0170766 A1 7/2012 Alves et al.
2012/0185524 A1 7/2012 Clark
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1* 12/2012 Alderson ..... G10K 11/178 381/71.11
2012/0308025 A1 12/2012 Hendrix et al.
2012/0308026 A1 12/2012 Karnath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0034236 A1* 2/2013 Hung ..... H04R 3/02 381/71.1
2013/0083939 A1* 4/2013 Fellers ..... G10K 11/178 381/71.11
2013/0156238 A1 6/2013 Birch et al.
2013/0197905 A1* 8/2013 Sugiyama ..... G10L 21/0208 704/226
2013/0222516 A1 8/2013 Do et al.

(56) References Cited

U.S. PATENT DOCUMENTS

| | | | | |
|---|---|---|---|---|
| 2013/0243198 | A1 | 9/2013 | Van Rumpt | |
| 2013/0243225 | A1 | 9/2013 | Yokota | |
| 2013/0259251 | A1 | 10/2013 | Bakalos | |
| 2013/0272539 | A1 | 10/2013 | Kim et al. | |
| 2013/0287218 | A1 | 10/2013 | Alderson et al. | |
| 2013/0287219 | A1 | 10/2013 | Hendrix et al. | |
| 2013/0301842 | A1 | 11/2013 | Hendrix et al. | |
| 2013/0301846 | A1* | 11/2013 | Alderson | H04R 3/002 381/71.7 |
| 2013/0301847 | A1 | 11/2013 | Alderson et al. | |
| 2013/0301848 | A1* | 11/2013 | Zhou | G10K 11/16 381/71.11 |
| 2013/0301849 | A1* | 11/2013 | Alderson | G10K 11/16 381/71.11 |
| 2013/0315403 | A1 | 11/2013 | Samuelsson | |
| 2013/0343556 | A1 | 12/2013 | Bright | |
| 2013/0343571 | A1 | 12/2013 | Rayala et al. | |
| 2014/0036127 | A1 | 2/2014 | Pong et al. | |
| 2014/0044275 | A1 | 2/2014 | Goldstein et al. | |
| 2014/0050332 | A1 | 2/2014 | Nielsen et al. | |
| 2014/0051483 | A1 | 2/2014 | Schoerkmaier | |
| 2014/0072134 | A1 | 3/2014 | Po et al. | |
| 2014/0072135 | A1 | 3/2014 | Bajic et al. | |
| 2014/0086425 | A1 | 3/2014 | Jensen et al. | |
| 2014/0126735 | A1 | 5/2014 | Gauger, Jr. | |
| 2014/0169579 | A1* | 6/2014 | Azmi | G10K 11/16 381/71.6 |
| 2014/0177851 | A1 | 6/2014 | Kitazawa et al. | |
| 2014/0177890 | A1 | 6/2014 | Hojlund et al. | |
| 2014/0211953 | A1 | 7/2014 | Alderson et al. | |
| 2014/0226827 | A1 | 8/2014 | Abdollahzadeh Milani et al. | |
| 2014/0270223 | A1 | 9/2014 | Li et al. | |
| 2014/0270224 | A1 | 9/2014 | Zhou et al. | |
| 2014/0277022 | A1 | 9/2014 | Hendrix et al. | |
| 2014/0294182 | A1 | 10/2014 | Axelsson | |
| 2014/0307887 | A1 | 10/2014 | Alderson et al. | |
| 2014/0307888 | A1 | 10/2014 | Alderson et al. | |
| 2014/0307890 | A1 | 10/2014 | Zhou et al. | |
| 2014/0307899 | A1 | 10/2014 | Hendrix et al. | |
| 2014/0314244 | A1 | 10/2014 | Yong et al. | |
| 2014/0314246 | A1 | 10/2014 | Hellmann | |
| 2014/0314247 | A1 | 10/2014 | Zhang | |
| 2014/0341388 | A1 | 11/2014 | Goldstein | |
| 2014/0369517 | A1 | 12/2014 | Zhou et al. | |
| 2015/0078572 | A1 | 3/2015 | Abdollahzadeh Milani et al. | |
| 2015/0092953 | A1 | 4/2015 | Abdollahzadeh Milani et al. | |
| 2015/0104032 | A1 | 4/2015 | Kwatra et al. | |
| 2015/0161980 | A1 | 6/2015 | Alderson et al. | |
| 2015/0161981 | A1 | 6/2015 | Kwatra | |
| 2015/0163592 | A1 | 6/2015 | Alderson | |
| 2015/0168467 | A1* | 6/2015 | Haneda | G01R 23/165 702/191 |
| 2015/0172813 | A1* | 6/2015 | Goto | H04R 3/002 381/71.1 |
| 2015/0256660 | A1 | 9/2015 | Kaller et al. | |
| 2015/0256953 | A1 | 9/2015 | Kwatra et al. | |
| 2015/0269926 | A1 | 9/2015 | Alderson et al. | |
| 2016/0180830 | A1 | 6/2016 | Lu et al. | |

FOREIGN PATENT DOCUMENTS

| | | | |
|---|---|---|---|
| EP | 0756407 | A2 | 1/1997 |
| EP | 0898266 | A2 | 2/1999 |
| EP | 1691577 | A2 | 8/2006 |
| EP | 1880699 | A2 | 1/2008 |
| EP | 1947642 | A1 | 7/2008 |
| EP | 2133866 | A1 | 12/2009 |
| EP | 2237573 | A1 | 10/2010 |
| EP | 2216774 | A1 | 8/2011 |
| EP | 2395500 | A1 | 12/2011 |
| EP | 2395501 | A1 | 12/2011 |
| EP | 2551845 | A1 | 1/2013 |
| EP | 2583074 | A1 | 4/2013 |
| EP | 2984648 | A2 | 2/2016 |
| EP | 2987160 | A1 | 2/2016 |
| EP | 2987162 | A1 | 2/2016 |
| EP | 2987337 | A1 | 2/2016 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| JP | H06186985 | A | 7/1994 |
| JP | H06232755 | | 8/1994 |
| JP | 07325588 | A | 12/1995 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2010277025 | | 12/2010 |
| JP | 2011061449 | | 3/2011 |
| WO | 1999011045 | | 3/1999 |
| WO | 2003015074 | A1 | 2/2003 |
| WO | 2003015275 | A1 | 2/2003 |
| WO | WO2004009007 | A1 | 1/2004 |
| WO | 2004017303 | A1 | 2/2004 |
| WO | 2006125061 | A1 | 11/2006 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2010117714 | A1 | 10/2010 |
| WO | 2011035061 | A1 | 3/2011 |
| WO | 2012107561 | A1 | 8/2012 |
| WO | 2012119808 | A2 | 9/2012 |
| WO | 2012134874 | A1 | 10/2012 |
| WO | 2012166273 | A2 | 12/2012 |
| WO | 2012166388 | A2 | 12/2012 |
| WO | 2013106370 | A1 | 7/2013 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088639 | A1 | 6/2015 |
| WO | 2015088651 | A1 | 6/2015 |
| WO | 2015088653 | A1 | 6/2015 |
| WO | 2015134225 | A1 | 9/2015 |
| WO | 2015191691 | A1 | 12/2015 |
| WO | 2016100602 | A1 | 6/2016 |

OTHER PUBLICATIONS

International Patent Application No. PCT/US2014/017112, International Search Report and Written Opinion, dated May 8, 2015, 22 pages.

International Search Report and Written Opinion of the International Searching Authority, International Patent Application No. PCT/US2014/017343, dated Aug. 8 2014, 22 pages.

International Search Report and Written Opinion of the International Searching Authority, International Patent Application No. PCT/US2014/018027, dated Sep. 4, 2014, 14 pages.

International Search Report and Written Opinion of the International Searching Authority, International Patent Application No. PCT/US2014/017374, dated Sep. 8, 2014, 13 pages.

International Search Report and Written Opinion of the International Searching Authority, International Patent Application No. PCT/US2014/019395, dated Sep. 9, 2014, 14 pages.

(56) References Cited

OTHER PUBLICATIONS

International Search Report and Written Opinion of the International Searching Authority, International Patent Application No. PCT/US2014/019469, dated Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, dated Oct. 18, 2014, 12 pages.
International Patent Application No. PCT/US2013/049407, International Search Report and Written Opinion, dated Jun. 18, 2014, 13 pages.
Kou, Sen and Tsai, Jianming, Residual noise shaping technique for active noise control systems, J. Acoust. Soc. Am. 95 (3), Mar. 1994, pp. 1665-1668.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al., "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMB Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium On Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Booji, P.S., Berkhoff, A.P., Virtual sensors for local, three dimensional, broadband multiple-channel active noise control and the effects on the quiet zones, Proceedings of ISMA2010 including USD2010, pp. 151-166.
Lopez-Caudana, Edgar Omar, Active Noise Cancellation: The Unwanted Signal and The Hybrid Solution, Adaptive Filtering Applications, Dr. Lino Garcia, ISBN: 978-953-307-306-4, InTech.
D. Senderowicz et al., "Low-Voltage Double-Sampled Delta-Sigma Converters," IEEE J. Solid-State Circuits, vol. 32 No. 12, pp. 1907-1919, Dec. 1997, 13 pages.
Hurst, P.J. and Dyer, K.C., "An improved double sampling scheme for switched-capacitor delta-sigma modulators," IEEE Int. Symp. Circuits Systems, May 1992, vol. 3, pp. 1179-1182, 4 pages.
Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.
Ryan, et al., "Optimum near-field performance of microphone arrays subject to a far-field beampattern constraint", 2248 J. Acoust. Soc. Am. 108, Nov. 2000.
Cohen, et al., "Noise Estimation by Minima Controlled Recursive Averaging for Robust Speech Enhancement", IEEE Signal Processing Letters, vol. 9, No. 1, Jan. 2002.
Martin, "Noise Power Spectral Density Estimation Based on Optimal Smoothing and Minimum Statistics", IEEE Trans. on Speech and Audio Processing, col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, dated May 27, 2014, 11 pages.

(56) References Cited

OTHER PUBLICATIONS

International Patent Application No. PCT/US2014/049600, International Search Report and Written Opinion, dated Jan. 14, 2015, 12 pages.
International Patent Application No. PCT/US2014/061753, International Search Report and Written Opinion, dated Feb. 9, 2015, 8 pages.
International Patent Application No. PCT/US2014/061548, International Search Report and Written Opinion, dated Feb. 12, 2015, 13 pages.
International Patent Application No. PCT/US2014/060277, International Search Report and Written Opinion, dated Mar. 9, 2015, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Patent Application No. PCT/US2015/017124, International Search Report and Written Opinion, dated Jul. 13, 2015, 19 pages.
International Patent Application No. PCT/US2015/035073, International Search Report and Written Opinion, dated Oct. 8, 2015, 11 pages.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, dated Jul. 23, 2015, 13 pages.
Combined Search and Examination Report, Application No. GB1519000.2, dated Apr. 21, 2016, 5 pages.
International Patent Application No. PCT/US2015/066260, International Search Report and Written Opinion, dated Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1512832.5, dated Jan. 28, 2016, 7 pages.

* cited by examiner

SYSTEMS AND METHODS FOR SELECTIVELY ENABLING AND DISABLING ADAPTATION OF AN ADAPTIVE NOISE CANCELLATION SYSTEM

FIELD OF DISCLOSURE

The present disclosure relates in general to adaptive noise cancellation in connection with an acoustic transducer, and more particularly, multi-mode adaptive cancellation for audio headsets.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

In an adaptive noise cancellation system, it is often desirable for the system to be fully adaptive such that a maximum noise cancellation effect is provided to a user at all times. However, when an adaptive noise cancellation system is adapting, it consumes more power than when it is not adapting. Therefore, it may be desirable to have a system that can determine when adaptation is needed, and only adapt during such times in order to reduce power consumption.

SUMMARY

In accordance with the teachings of the present disclosure, certain disadvantages and problems associated with power consumption of an adaptive noise cancellation system may be reduced or eliminated.

In accordance with embodiments of the present disclosure, an integrated circuit for implementing at least a portion of a personal audio device may include an output, an error microphone input, and a processing circuit. The output may be configured to provide an output signal to a transducer including both a source audio signal for playback to a listener and an anti-noise signal for countering the effect of ambient audio sounds in an acoustic output of the transducer. The error microphone input may be configured to receive an error microphone signal indicative of the output of the transducer and the ambient audio sounds at the transducer. The processing circuit may implement an anti-noise generating filter, a secondary path estimate filter, and a controller. The anti-noise generating filter may have a response that generates the anti-noise signal based at least on the reference microphone signal. The secondary path estimate filter may be configured to model an electro-acoustic path of the source audio signal and have a response that generates a secondary path estimate from the source audio signal, wherein at least one of the response of the anti-noise generating filter and the response of the secondary path estimate filter is an adaptive response shaped by an adaptive coefficient control block. The adaptive coefficient control block may include at least one of a filter coefficient control block that shapes the response of the anti-noise generating filter by adapting the response of the anti-noise generating filter to minimize the ambient audio sounds in the error microphone signal and a secondary path estimate coefficient control block that shapes the response of the secondary path estimate filter in conformity with the source audio signal and a playback corrected error by adapting the response of the secondary path estimate filter to minimize the playback corrected error; wherein the playback corrected error is based on a difference between the error microphone signal and the secondary path estimate. The controller may be configured to determine a degree of convergence of the adaptive response, enable adaptation of the adaptive coefficient control block if the degree of convergence of the adaptive response is below a particular threshold, and disable adaptation of the adaptive coefficient control block if the degree of convergence of the adaptive response is above a particular threshold.

In accordance with these and other embodiments of the present disclosure, a method for canceling ambient audio sounds in the proximity of a transducer of a personal audio device may include receiving an error microphone signal indicative of an acoustic output of the transducer and the ambient audio sounds at the transducer. The method may further include adaptively generating an anti-noise signal to reduce the presence of the ambient audio sounds heard by the listener by adapting an adaptive response of an adaptive noise cancellation system to minimize the ambient audio sounds at the acoustic output of the transducer, wherein adaptively generating the anti-noise signal comprises generating the anti-noise signal from based on at least the error microphone signal with an anti-noise generating filter, generating a secondary path estimate from the source audio signal with a secondary path estimate filter for modeling an electro-acoustic path of a source audio signal, and at least one of: (i) adaptively generating the anti-noise signal by shaping a response of the anti-noise generating filter by adapting the response of the anti-noise generating filter to minimize the ambient audio sounds in the error microphone signal, wherein the adaptive response comprises the response of the anti-noise generating filter; and (ii) adaptively generating the secondary path estimate by shaping a response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate, wherein the adaptive response comprises the response of the secondary path estimate filter. The method may additionally include combining the anti-noise signal with a source audio signal to generate an output signal provided to the transducer. The method may further include determining a degree of convergence of the adaptive response, enabling adaptation of the adaptive response if the degree of convergence of the adaptive response is below a particular threshold, and disabling adaptation of the adaptive response if the degree of convergence of the adaptive response is above a particular threshold.

In accordance with these and other embodiments of the present disclosure, a personal audio device may include a transducer and an error microphone. The transducer may be configured to reproduce an output signal including both a source audio signal for playback to a listener and an anti-noise signal for countering the effects of ambient audio sounds in an acoustic output of the transducer. The error microphone may be configured to generate an error microphone signal indicative of the output of the transducer and the ambient audio sounds at the transducer. The processing circuit may implement an anti-noise generating filter, a secondary path estimate filter, and a controller. The anti-noise generating filter may have a response that generates the anti-noise signal based at least on the reference microphone signal. The secondary path estimate filter may be configured to model an electro-acoustic path of the source audio signal and have a response that generates a secondary path estimate from the source audio signal, wherein at least one of the response of the anti-noise generating filter and the response of the secondary path estimate filter is an adaptive response shaped by an adaptive coefficient control block. The adaptive coefficient control block may include at least one of a filter coefficient control block that shapes the response of the anti-noise generating filter by adapting the response of the anti-noise generating filter to minimize the ambient audio sounds in the error microphone signal and a secondary path estimate coefficient control block that shapes the response of the secondary path estimate filter in conformity with the source audio signal and a playback corrected error by adapting the response of the secondary path estimate filter to minimize the playback corrected error; wherein the playback corrected error is based on a difference between the error microphone signal and the secondary path estimate. The controller may be configured to determine a degree of convergence of the adaptive response, enable adaptation of the adaptive coefficient control block if the degree of convergence of the adaptive response is below a particular threshold, and disable adaptation of the adaptive coefficient control block if the degree of convergence of the adaptive response is above a particular threshold.

In accordance with these and other embodiments of the present disclosure, an integrated circuit for implementing at least a portion of a personal audio device may include a controller configured to determine a degree of convergence of an adaptive response of an adaptive filter in an adaptive noise cancellation system, enable adaptation of the adaptive response if the degree of convergence of the adaptive response is below a particular threshold, and disable adaptation of the adaptive response if the degree of convergence of the adaptive response is above a particular threshold.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electro-acoustic path from the output of the processing circuit through the transducer.

Figure 1A:
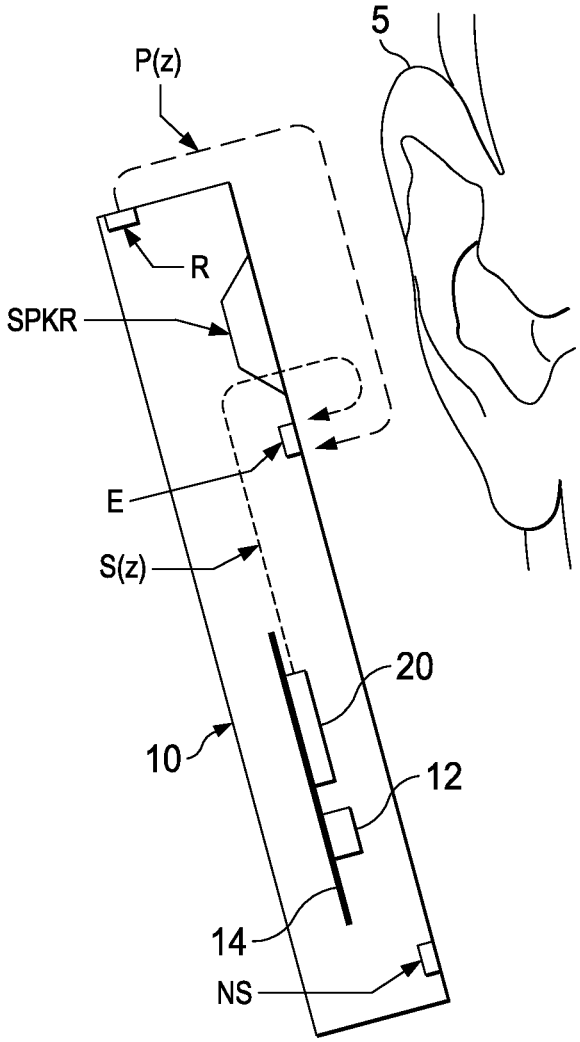
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of this disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
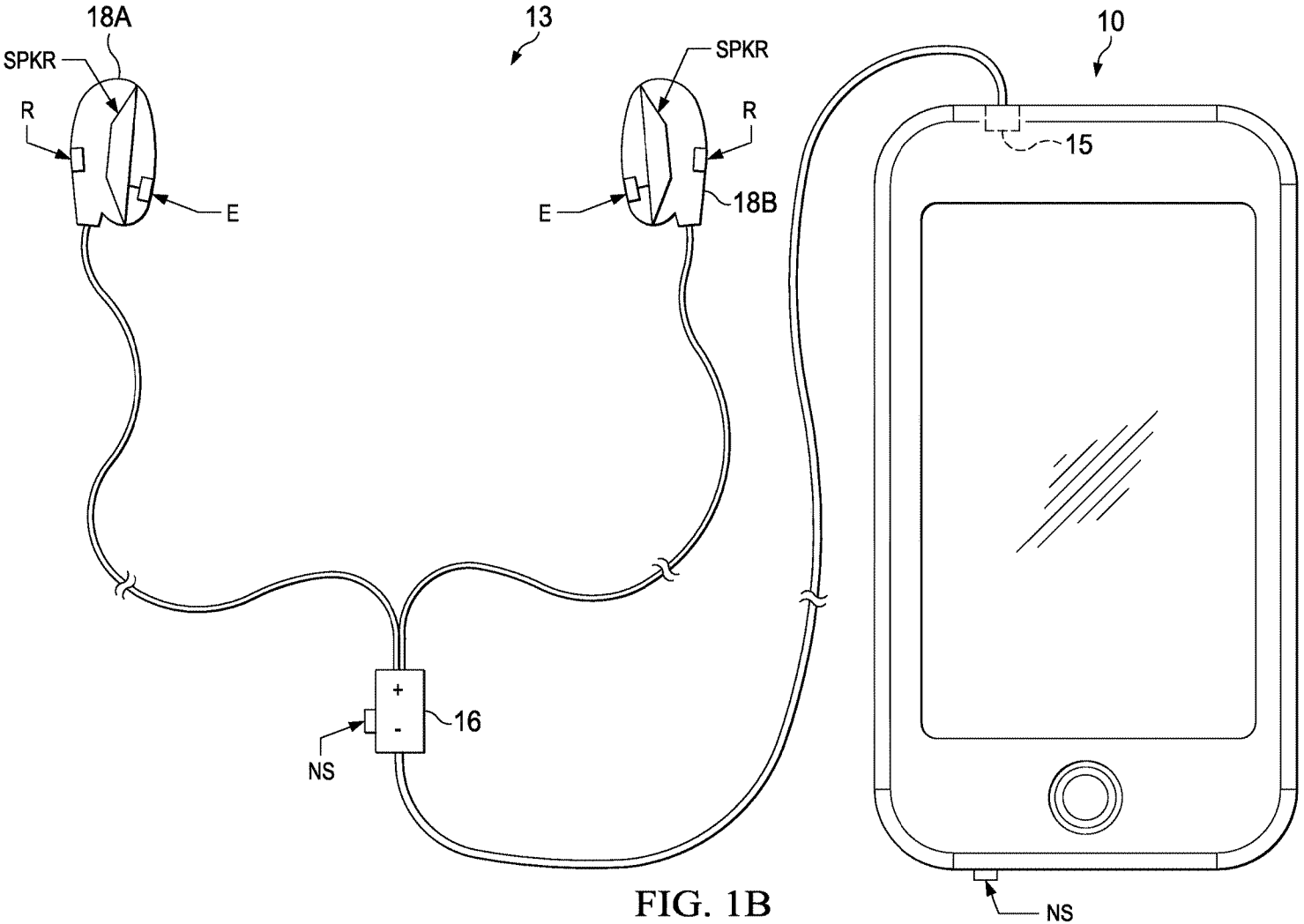
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
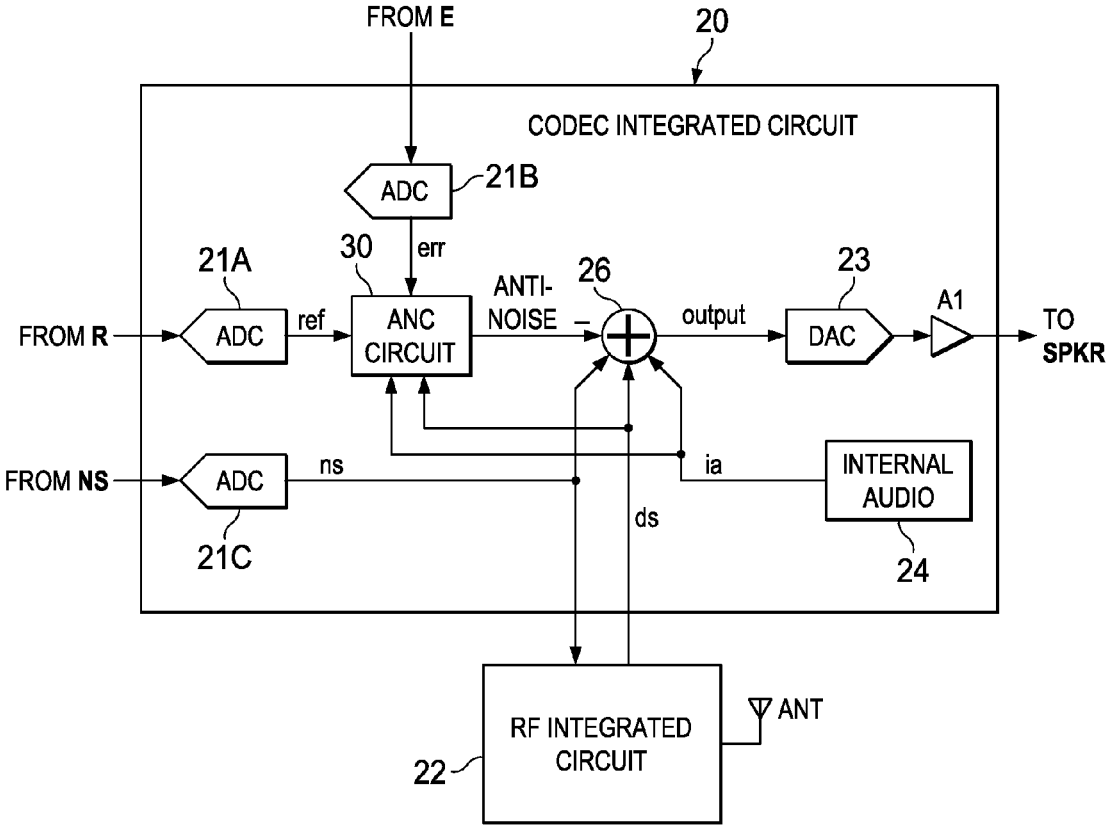
FIG. 2 is a block diagram of selected circuits within the wireless mobile telephone depicted in FIG. 1, in accordance with embodiments of the present disclosure.

Referring now to FIG. 2, selected circuits within wireless telephone 10 are shown in a block diagram, which in other embodiments may be placed in whole or in part in other locations such as one or more headphones or earbuds. CODEC IC 20 may include an analog-to-digital converter (ADC) 21A for receiving the reference microphone signal from microphone R and generating a digital representation ref of the reference microphone signal, an ADC 21B for receiving the error microphone signal from erro microphone E and generating a digital representation err of the error microphone signal, and an ADC 21C for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
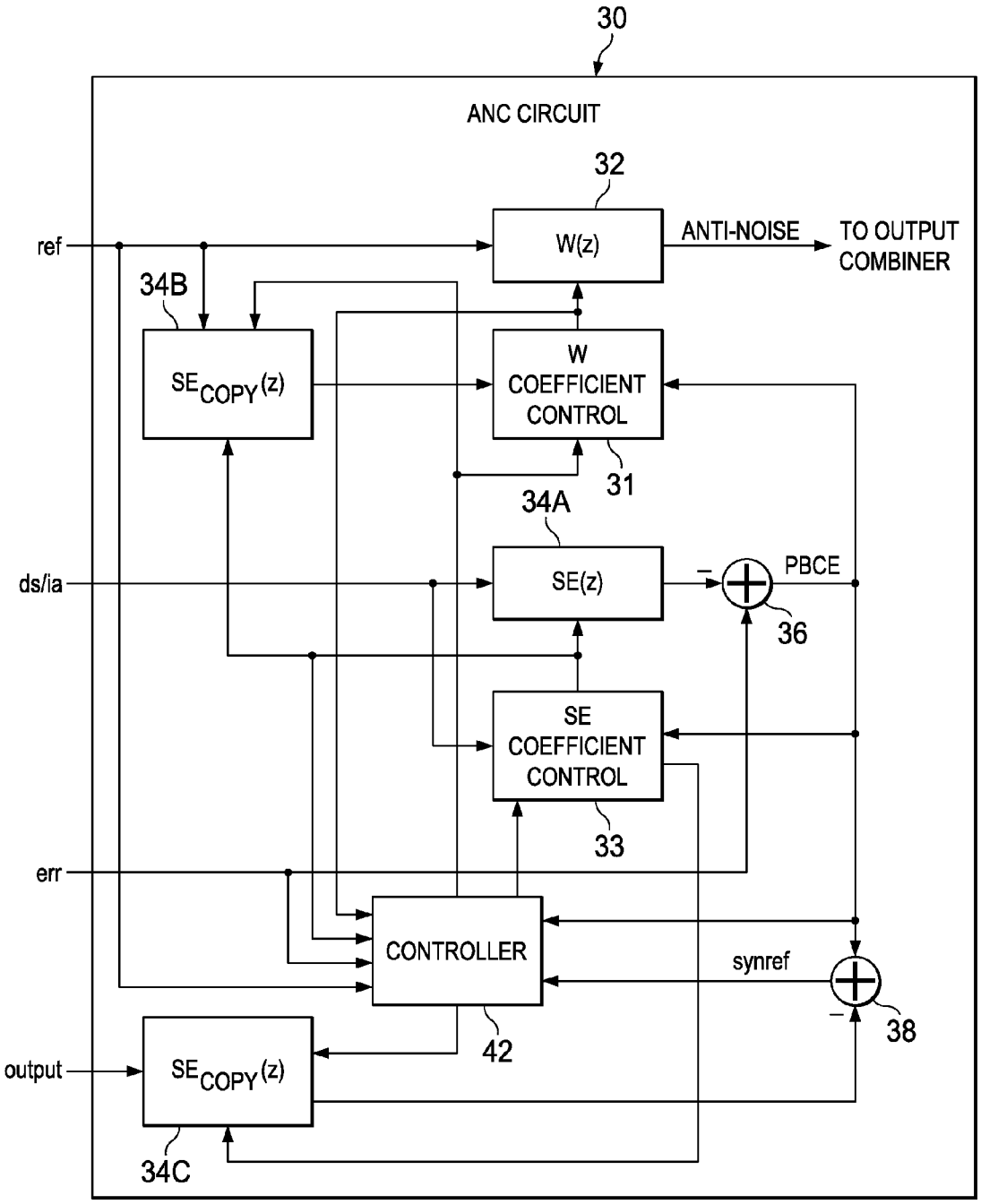
FIG. 3 is a block diagram depicting selected signal processing circuits and functional blocks within an example adaptive noise canceling (ANC) circuit of a coder-decoder (CODEC) integrated circuit of FIG. 2 which uses feedforward filtering to generate an anti-noise signal, in accordance with embodiments of the present disclosure.

Referring now to FIG. 3, details of ANC circuit 30 are shown in accordance with embodiments of the present disclosure. Adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and a playback corrected error, labeled as "PBCE" in FIG. 3, based at least in part on error microphone signal err. The playback corrected error may be generated as described in greater detail below. By transforming reference microphone signal ref with a copy of the estimate of the response of path S(z), response $SE_{COPY}(z)$ of filter 34B, and minimizing the difference between the resultant signal and error microphone signal err, adaptive filter 32 may adapt to the desired response of P(z)/S(z). In addition to error microphone signal err, the playback corrected error signal compared to the output of filter 34B by W coefficient control block 31 may include an inverted amount of source audio signal (e.g., downlink audio signal ds and/or internal audio signal ia), that has been processed by filter response SE(z), of which response $SE_{COPY}(z)$ is a copy. By injecting an inverted amount of source audio signal, adaptive filter 32 may be prevented from adapting to the relatively large amount of source audio signal present in error microphone signal err. However, by transforming that inverted copy of the source audio signal with the estimate of the response of path S(z), the source audio that is removed from error microphone signal err should match the expected version of the source audio signal reproduced at error microphone signal err, because the electrical and acoustical path of S(z) is the path taken by the source audio signal to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare the source audio signal and a playback corrected error. The playback corrected error may be equal to error microphone signal err after removal of the equalized source audio signal (as filtered by filter 34A to represent the expected playback audio delivered to error microphone E) by a combiner 36. SE coefficient control block 33 may correlate the actual equalized source audio signal with the components of the equalized source audio signal that are present in error microphone signal err. Adaptive filter 34A may thereby be adapted to generate a secondary estimate signal from the equalized source audio signal, that when subtracted from error microphone signal err to generate the playback corrected error, includes the content of error microphone signal err that is not due to the equalized source audio signal.

Also as shown in FIG. 3, ANC circuit 30 may include a controller 42. As described in greater detail below, controller 42 may be configured to determine a degree of convergence of an adaptive response (e.g., response W(z) and/or response SE(z)) of ANC circuit 30. Such determination may be made based on one or more signals associated with ANC circuit 30, including without limitation the audio output signal, reference microphone signal ref, error microphone signal err, the playback corrected error, coefficients generated by W coefficient control block 31, and coefficients generated by SE coefficient control block 33. For purposes of this disclosure, "convergence" of an adaptive response may generally mean a state in which such adaptive response substantially unchanging over a period of time. For example, if the ambient environment around a personal audio device (e.g., wireless telephone) is predominantly static, adaptation of an adaptive response of ANC circuit 30 may be minimal in the sense that such response may not change significantly over a period of time. Thus a "degree of convergence" may be a measure of the extent to which an adaptive response adapts over a period of time.

If the degree of convergence of the adaptive response is below a particular threshold (e.g., the adaptive response is adapting over a period of time in excess of a threshold level of adaptation), controller 42 may enable adaptation of the adaptive response. On the other hand, if the degree of convergence of the adaptive response is above a particular threshold (e.g., the adaptive response is adapting over a period of time less than a threshold level of adaptation), controller 42 may disable adaptation of the adaptive response. Example approaches for determining a degree of convergence and the particular thresholds relevant to such approaches may be described in greater detail below in reference to FIGS. 4-8.

In some embodiments, controller 42 may disable adaptation of an adaptive response by disabling a coefficient control block (e.g., W coefficient control block 31 and/or SE coefficient control block 33) associated with the adaptive response. In these and other embodiments, controller 42 may disable adaptation of an adaptive response (e.g., response W(z)) by disabling filter 34B and/or filter 34C (filter 34C is described in greater detail below). In these and other embodiments, controller 42 may disable adaptation of an adaptive response (e.g., W(z)) by disabling oversight detectors of ANC circuit 30 used to ensure stability in the adaptation of response W(z).

In some embodiments, controller 42 may, as described in greater detail below with respect to FIGS. 4-6, be configured to determine a degree of convergence of an adaptive response (e.g., W(z) and/or SE(z)) by adapting the adaptive response for a first period of time, determining coefficients of an adaptive coefficient control block (e.g., W coefficient control block 31 and/or SE coefficient control block 33) associated with the adaptive response at the end of the first period of time, adapting the adaptive response for a second period of time, determining coefficients of the adaptive coefficient control block at the end of the second period of time, and comparing the coefficients of the adaptive coefficient control block at the end of the first period of time to the coefficients of the adaptive coefficient control block at the end of the second period of time. For example, controller 42 may determine the degree of convergence to be above the particular threshold if the coefficients of the adaptive coefficient control block at the end of the second period of time are within a threshold error of the coefficients of the adaptive coefficient control block at the end of the first period of time, and responsive to such determination, disable adaptation of the adaptive response (e.g., W(z) and/or SE(z)). Similarly, controller 42 may determine the degree of convergence to be below the particular threshold if the coefficients of the adaptive coefficient control block at the end of the second period of time are not within the threshold error, and responsive to such determination, enable adaptation of the adaptive response.

Figure 4:
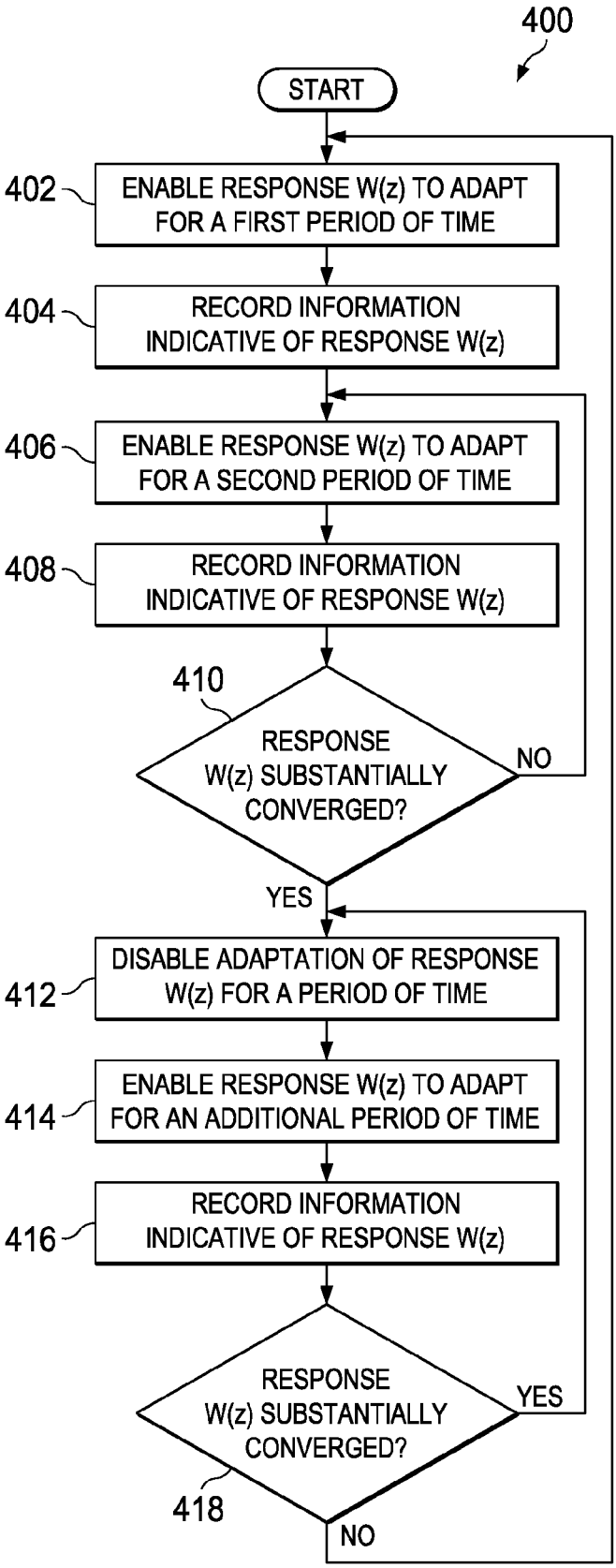
FIG. 4 is a flow chart of an example method for selectively enabling and disabling adaptation of an ANC circuit based on monitoring of an adaptive response of a feedforward filter W(z), in accordance with embodiments of the present disclosure.

In some of such embodiments, controller 42 may determine a degree of convergence of adaptive responsive W(z) by monitoring adaptive response W(z), as shown in FIG. 4. FIG. 4 is a flow chart of an example method 400 for selectively enabling and disabling adaptation of ANC circuit 30 based on monitoring of adaptive response W(z), in accordance with embodiments of the present disclosure. According to some embodiments, method 400 begins at step 402. As noted above, teachings of the present disclosure are implemented in a variety of configurations of wireless telephone 10. As such, the preferred initialization point for method 400 and the order of the steps comprising method 400 may depend on the implementation chosen.

At step 402, controller 42 may enable response W(z) to adapt for a first period of time (e.g., 1000 milliseconds). At step 404, at the end of the first period of time, controller 42 may record information indicative of response W(z), such as the response itself or the coefficients of W coefficient control block 31.

At step 406, controller 42 may continue to enable response W(z) to adapt for a second period of time (e.g., 100 milliseconds). At step 408, the end of the second period of time, controller 42 may record information indicative of response W(z), such as the response itself or the coefficients of W coefficient control block 31.

At step 410, controller 42 may compare information indicative of response W(z) at the end of the second period of time to the information indicative of response W(z) recorded at the end of the first period of time to determine the degree of convergence of response W(z). If information indicative of response W(z) at the end of the second period of time is within a predetermined threshold error of the information indicative of response W(z) recorded at the end of the first period of time, controller 42 may determine that response W(z) is substantially converged, and may proceed to step 412. Otherwise, controller 42 may determine that response W(z) is not substantially converged, and may proceed again to step 406.

At step 412, in response to the determination that response W(z) is substantially converged, controller 42 may disable adaptation of response W(z) and power down one or more components associated with adaptation of response W(z) for a period of time (e.g., 1000 milliseconds). At step 414, after adaptation of response W(z) has been disabled for the period of time, controller 42 may enable response W(z) to adapt for an additional period of time (e.g., 100 milliseconds). At step 416, at the end of the additional period of time, controller 42 may record information indicative of response W(z), such as the response itself or the coefficients of W coefficient control block 31.

At step 418, controller 42 may compare information indicative of response W(z) at the end of the additional period of time to the information indicative of response W(z) recorded at the end of the period of time in which adaptation of response W(z) was most-recently enabled to determine the degree of convergence of response W(z). If information indicative of response W(z) at the end of the additional period of time is within a predetermined threshold error of the information indicative of response W(z) recorded at the end of the period of time in which adaptation of response W(z) was most-recently enabled, controller 42 may determine that response W(z) is substantially converged, and may proceed to step 412. Otherwise, controller 42 may determine that response W(z) is not substantially converged, and may proceed again to step 402.

Although FIG. 4 discloses a particular number of steps to be taken with respect to method 400, method 400 may be executed with greater or fewer steps than those depicted in FIG. 4. In addition, although FIG. 4 discloses a certain order of steps to be taken with respect to method 400, the steps comprising method 400 may be completed in any suitable order.

Method 400 may be implemented using wireless telephone 10 or any other system operable to implement method 400. In certain embodiments, method 400 may be implemented partially or fully in software and/or firmware embodied in computer-readable media and executable by a controller.

Figure 5:
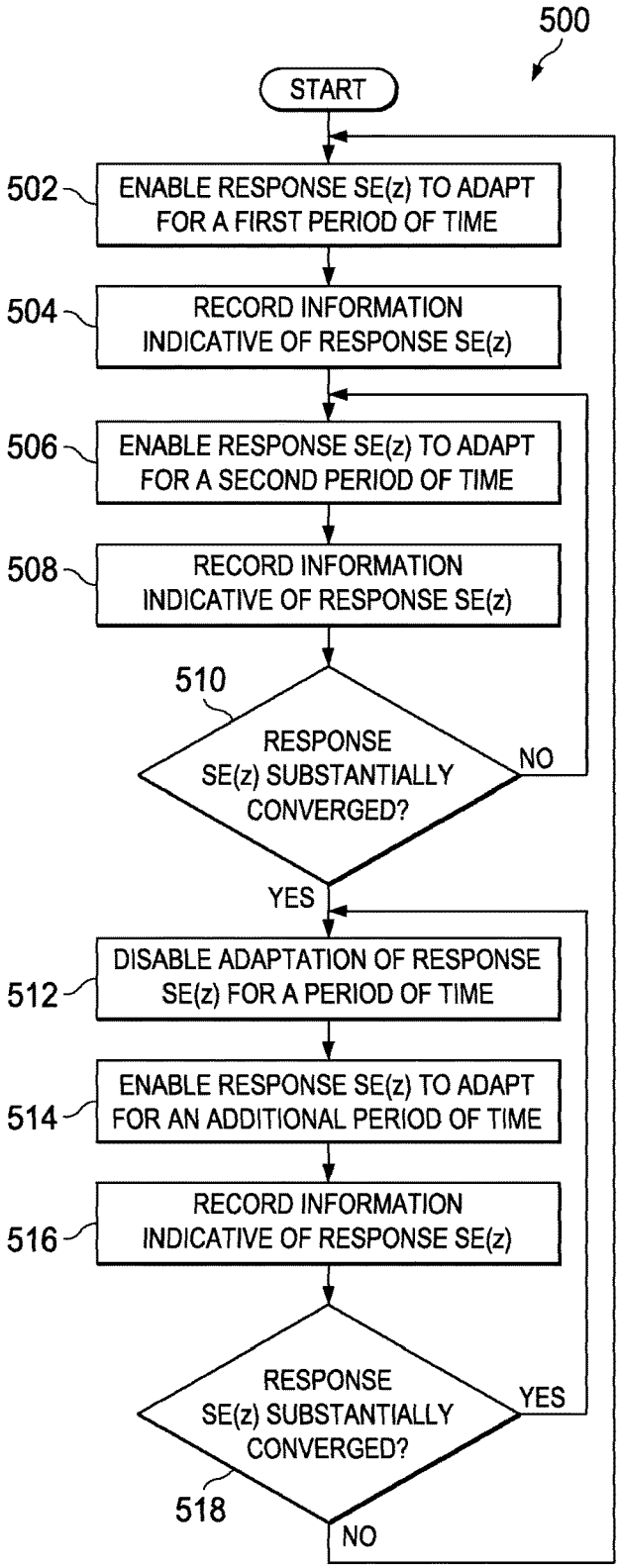
FIG. 5 is a flow chart of an example method for selectively enabling and disabling adaptation of an ANC circuit based on monitoring of an adaptive response of a secondary path estimate filter, in accordance with embodiments of the present disclosure.

In addition or alternatively, controller 42 may determine a degree of convergence of adaptive responsive SE(z) by monitoring adaptive response SE(z), as shown in FIG. 5. FIG. 5 is a flow chart of an example method 500 for selectively enabling and disabling adaptation of ANC circuit 30 based on monitoring of adaptive response SE(z), in accordance with embodiments of the present disclosure. According to some embodiments, method 500 begins at step 502. As noted above, teachings of the present disclosure are implemented in a variety of configurations of wireless telephone 10. As such, the preferred initialization point for method 500 and the order of the steps comprising method 500 may depend on the implementation chosen.

At step 502, controller 42 may enable response SE(z) to adapt for a first period of time (e.g., 100 milliseconds). At step 504, at the end of the first period of time, controller 42 may record information indicative of response SE(z), such as the response itself or the coefficients of SE coefficient control block 33.

At step 506, controller 42 may continue to enable response SE(z) to adapt for a second period of time (e.g., 10 milliseconds). At step 508, the end of the second period of time, controller 42 may record information indicative of response SE(z), such as the response itself or the coefficients of SE coefficient control block 33.

At step 510, controller 42 may compare information indicative of response SE(z) at the end of the second period of time to the information indicative of response SE(z) recorded at the end of the first period of time to determine the degree of convergence of response SE(z). If information indicative of response SE(z) at the end of the second period of time is within a predetermined threshold error of the information indicative of response SE(z) recorded at the end of the first period of time, controller 42 may determine that response SE(z) is substantially converged, and may proceed to step 512. Otherwise, controller 42 may determine that response SE(z) is not substantially converged, and may proceed again to step 506.

At step 512, in response to the determination that response SE(z) is substantially converged, controller 42 may disable adaptation of response SE(z) and power down one or more components associated with adaptation of response SE(z) for a period of time (e.g., 100 milliseconds). At step 514, after adaptation of response SE(z) has been disabled for the period of time, controller 42 may enable response SE(z) to adapt for an additional period of time (e.g., 10 milliseconds). At step 516, at the end of the additional period of time, controller 42 may record information indicative of response SE(z), such as the response itself or the coefficients of SE coefficient control block 33.

At step 518, controller 42 may compare information indicative of response SE(z) at the end of the additional period of time to the information indicative of response SE(z) recorded at the end of the period of time in which adaptation of response SE(z) was most-recently enabled to determine the degree of convergence of response SE(z). If information indicative of response SE(z) at the end of the additional period of time is within a predetermined threshold error of the information indicative of response SE(z) recorded at the end of the period of time in which adaptation of response SE(z) was most-recently enabled, controller 42 may determine that response SE(z) is substantially converged, and may proceed to step 512. Otherwise, controller 42 may determine that response SE(z) is not substantially converged, and may proceed again to step 502.

Although FIG. 5 discloses a particular number of steps to be taken with respect to method 500, method 500 may be executed with greater or fewer steps than those depicted in FIG. 5. In addition, although FIG. 5 discloses a certain order of steps to be taken with respect to method 500, the steps comprising method 500 may be completed in any suitable order.

Method 500 may be implemented using wireless telephone 10 or any other system operable to implement method 500. In certain embodiments, method 500 may be implemented partially or fully in software and/or firmware embodied in computer-readable media and executable by a controller.

Figure 6:
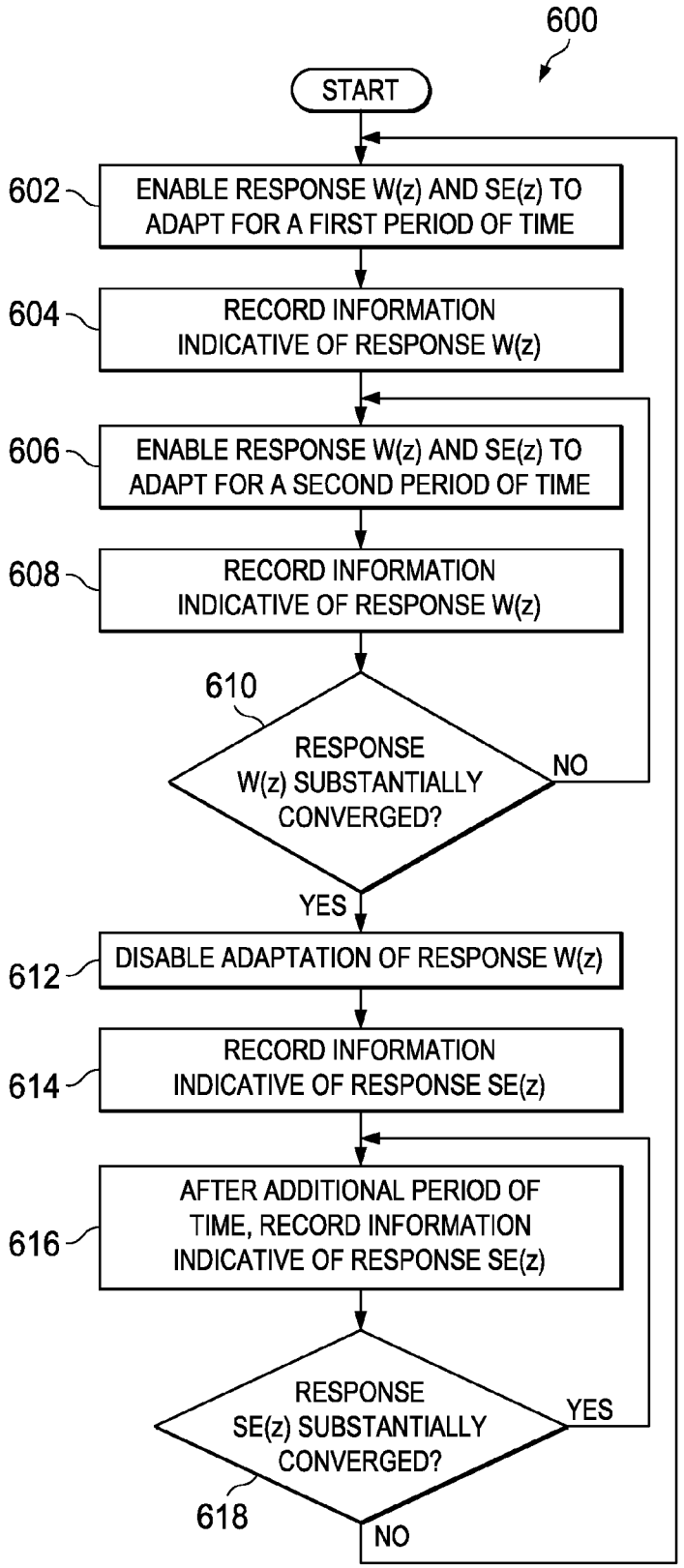
FIG. 6 is a flow chart of an example method for selectively enabling and disabling adaptation of an ANC circuit based on monitoring of adaptive responses of a feedforward filter and a secondary path estimate filter, in accordance with embodiments of the present disclosure.

In addition or alternatively, controller 42 may determine a degree of convergence of adaptive responsive W(z) by monitoring both adaptive responses W(z) and SE(z), as shown in FIG. 6. FIG. 6 is a flow chart of an example method 600 for selectively enabling and disabling adaptation of ANC circuit 30 based on monitoring of adaptive responses W(z) and SE(z), in accordance with embodiments of the present disclosure. According to some embodiments, method 600 begins at step 602. As noted above, teachings of the present disclosure are implemented in a variety of configurations of wireless telephone 10. As such, the preferred initialization point for method 600 and the order of the steps comprising method 600 may depend on the implementation chosen.

At step 602, controller 42 may enable responses W(z) and SE(z) to adapt for a first period of time. At step 604, at the end of the first period of time, controller 42 may record information indicative of response W(z), such as the response itself or the coefficients of W coefficient control block 31.

At step 606, controller 42 may continue to enable responses W(z) and SE(z) to adapt for a second period of time. At step 608, the end of the second period of time, controller 42 may record information indicative of response W(z), such as the response itself or the coefficients of W coefficient control block 31.

At step 610, controller 42 may compare information indicative of response W(z) at the end of the second period of time to the information indicative of response W(z) recorded at the end of the first period of time to determine the degree of convergence of response W(z). If information indicative of response W(z) at the end of the second period of time is within a predetermined threshold error of the information indicative of response W(z) recorded at the end of the first period of time, controller 42 may determine that response W(z) is substantially converged, and may proceed to step 612. Otherwise, controller 42 may determine that response W(z) is not substantially converged, and may proceed again to step 606.

At step 612, in response to the determination that response W(z) is substantially converged, controller 42 may disable adaptation of response W(z) and power down one or more components associated with adaptation of response W(z), but may enable response SE(z) to continue to adapt. At step 614, controller 42 may record information indicative of response SE(z), such as the response itself or the coefficients of SE coefficient control block 33.

At step 616, after an additional period of time, controller 42 may again record information indicative of response SE(z), such as the response itself or the coefficients of SE coefficient control block 33. At step 618, controller 42 may compare information indicative of response SE(z) at the end of the additional period of time to the information indicative of response SE(z) recorded prior to the additional period of time. If information indicative of response SE(z) at the end of the additional period of time is within a predetermined threshold error of the information indicative of response SE(z) recorded prior to the additional period of time, controller 42 may determine that response SE(z) is substantially converged, and may proceed again to step 616. Otherwise, controller 42 may determine that response SE(z) is not substantially converged, and may proceed again to step 602.

Although FIG. 6 discloses a particular number of steps to be taken with respect to method 600, method 600 may be executed with greater or fewer steps than those depicted in FIG. 6. In addition, although FIG. 6 discloses a certain order of steps to be taken with respect to method 600, the steps comprising method 600 may be completed in any suitable order.

Method 600 may be implemented using wireless telephone 10 or any other system operable to implement method 600. In certain embodiments, method 600 may be implemented partially or fully in software and/or firmware embodied in computer-readable media and executable by a controller.

In these and other embodiments, controller 42 may, as described in greater detail below with respect to FIG. 7, be configured to determine the degree of convergence of the adaptive response by determining an adaptive noise cancellation gain of ANC circuit 30 at a first time, determining the adaptive noise cancellation gain at a second time, and comparing the adaptive noise cancellation gain at the first time to the adaptive noise cancellation gain at the second time. The adaptive noise cancellation gain may be defined as a synthesized reference microphone signal synref divided by the playback corrected error, and synthesized reference microphone signal synref may be based on a difference between the playback corrected error and the output signal. For example, the output signal generated by combiner 26 may be filtered by filter 34C which applies a response $SE_{COPY}(z)$ which is a copy of the response SE(z) of filter 34A. The filtered output signal may then be subtracted from the playback corrected error by combiner 38 in order to generate synthesized reference microphone signal synref. In such embodiments, controller 42 may determine the degree of convergence to be above the particular threshold if the adaptive noise cancellation gain at the second time is within a threshold error of the adaptive noise cancellation gain at the first time, and responsive to such determination, disable adaptation of the adaptive response (e.g., W(z) and/or SE(z)). Similarly, controller 42 may determine the degree of convergence to be below the particular threshold if the adaptive noise cancellation gain at the end of the second time is not within the threshold error, and responsive to such determination, enable adaptation of the adaptive response.

Figure 7:
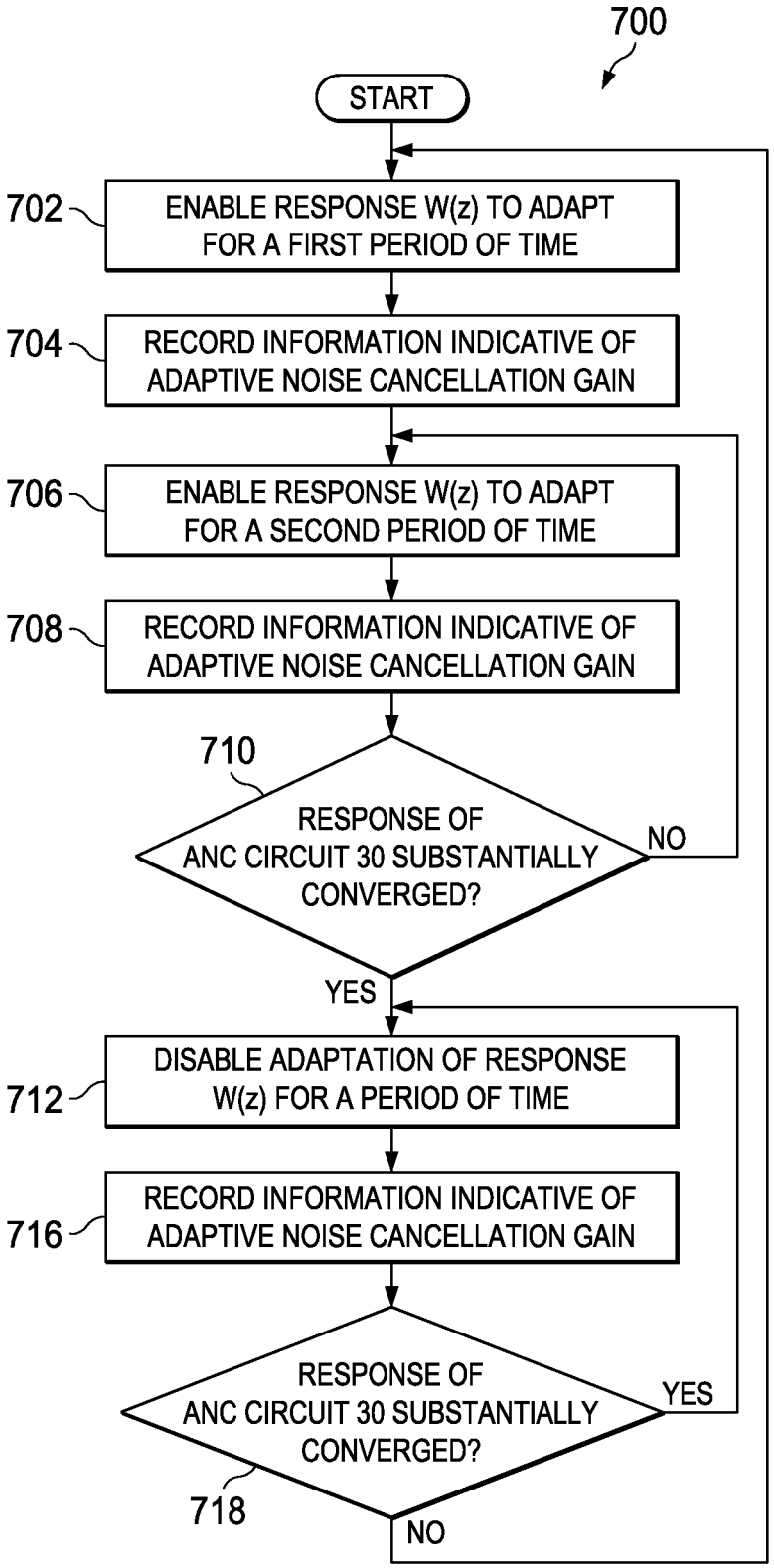
FIG. 7 is a flow chart of an example method for selectively enabling and disabling adaptation of an ANC circuit based on monitoring of an adaptive noise cancellation gain of the ANC circuit, in accordance with embodiments of the present disclosure.

FIG. 7 is a flow chart of an example method 700 for selectively enabling and disabling adaptation of ANC circuit 30 based on monitoring of adaptive noise cancellation gain of ANC circuit 30, in accordance with embodiments of the present disclosure. According to some embodiments, method 700 begins at step 702. As noted above, teachings of the present disclosure are implemented in a variety of configurations of wireless telephone 10. As such, the preferred initialization point for method 700 and the order of the steps comprising method 700 may depend on the implementation chosen.

At step 702, controller 42 may enable response W(z) to adapt for a first period of time. At step 704, at the end of the first period of time, controller 42 may record information indicative of the adaptive noise cancellation gain (e.g., the response of the adaptive noise cancellation gain as a function of frequency).

At step 706, controller 42 may continue to enable response W(z) to adapt for a second period of time. At step 708, the end of the second period of time, controller 42 may record information indicative of the adaptive noise cancellation gain (e.g., the response of the adaptive noise cancellation gain as a function of frequency).

At step 710, controller 42 may compare information indicative of the adaptive noise cancellation gain at the end of the second period of time to the information indicative of the adaptive noise cancellation gain recorded at the end of the first period of time to determine the degree of convergence of ANC circuit 30. If information indicative of the adaptive noise cancellation gain at the end of the second period of time is within a predetermined threshold error of the information indicative of the adaptive noise cancellation gain recorded at the end of the first period of time, controller 42 may determine that ANC circuit 30 is substantially converged, and may proceed to step 712. Otherwise, controller 42 may determine that ANC circuit 30 is not substantially converged, and may proceed again to step 706.

At step 712, in response to the determination that ANC circuit 30 is substantially converged, controller 42 may disable adaptation of response W(z) and power down one or more components associated with adaptation of response W(z) for an additional period of time. At step 716, at the end of the additional period of time, controller 42 may record information indicative of the adaptive noise cancellation gain (e.g., the response of the adaptive noise cancellation gain as a function of frequency).

At step 718, controller 42 may compare information indicative of the adaptive noise cancellation gain at the end of the additional period of time to the information indicative of the adaptive noise cancellation gain recorded at the end of the period of time in which adaptation of response W(z) was most-recently enabled to determine the degree of convergence of ANC circuit 30. If information indicative of the adaptive noise cancellation gain at the end of the additional period of time is within a predetermined threshold error of the information indicative of the adaptive noise cancellation gain recorded at the end of the period of time in which adaptation of response W(z) was most-recently enabled, controller 42 may determine that ANC circuit 30 is substantially converged, and may proceed to step 712. Otherwise, controller 42 may determine that ANC circuit 30 is not substantially converged, and may proceed again to step 702. Although FIG. 7 discloses a particular number of steps to be taken with respect to method 700, method 700 may be executed with greater or fewer steps than those depicted in FIG. 7. In addition, although FIG. 7 discloses a certain order of steps to be taken with respect to method 700, the steps comprising method 700 may be completed in any suitable order.

Method 700 may be implemented using wireless telephone 10 or any other system operable to implement method 700. In certain embodiments, method 700 may be implemented partially or fully in software and/or firmware embodied in computer-readable media and executable by a controller.

In addition or alternatively to monitoring the adaptive noise cancellation gain, controller 42 may be configured to determine the degree of convergence of the adaptive response by determining a cross-correlation between the reference microphone signal and the playback corrected error. For example, controller 42 may determine the degree of convergence to be above the particular threshold if the cross-correlation is lesser than a threshold cross-correlation, and responsive to such determination, disable adaptation of the adaptive response (e.g., W(z) and/or SE(z)). Similarly, controller 42 may determine the degree of convergence to be below the particular threshold if the cross-correlation is greater than a threshold cross-correlation, and responsive to such determination, enable adaptation of the adaptive response.

In these and other embodiments, controller 42 may, as described in greater detail below with respect to FIG. 8, be configured to determine the degree of convergence of the adaptive response by adapting the adaptive response for a first period of time, determining a secondary path estimate filter cancellation gain at the end of the first period of time, adapting the adaptive response for a second period of time, determining the secondary path estimate filter cancellation gain at the end of the second period of time, and comparing the secondary path estimate filter cancellation gain at the end of the first period of time to the secondary path estimate filter cancellation gain at the end of the second period of time. The secondary path estimate filter cancellation gain may be defined as the playback corrected error divided by error microphone signal err. In such embodiments, controller 42 may determine the degree of convergence to be above the particular threshold if the secondary path estimate filter cancellation gain at the end of the second period of time is within a threshold error of the secondary path estimate filter cancellation gain at the end of the first period of time, and responsive to such determination, disable adaptation of the adaptive response (e.g., W(z) and/or SE(z)). Similarly, controller 42 may determine the degree of convergence to be below the particular threshold if the secondary path estimate filter cancellation gain at the end of the second period of time is not within the threshold error, and responsive to such determination, enable adaptation of the adaptive response.

Figure 8:
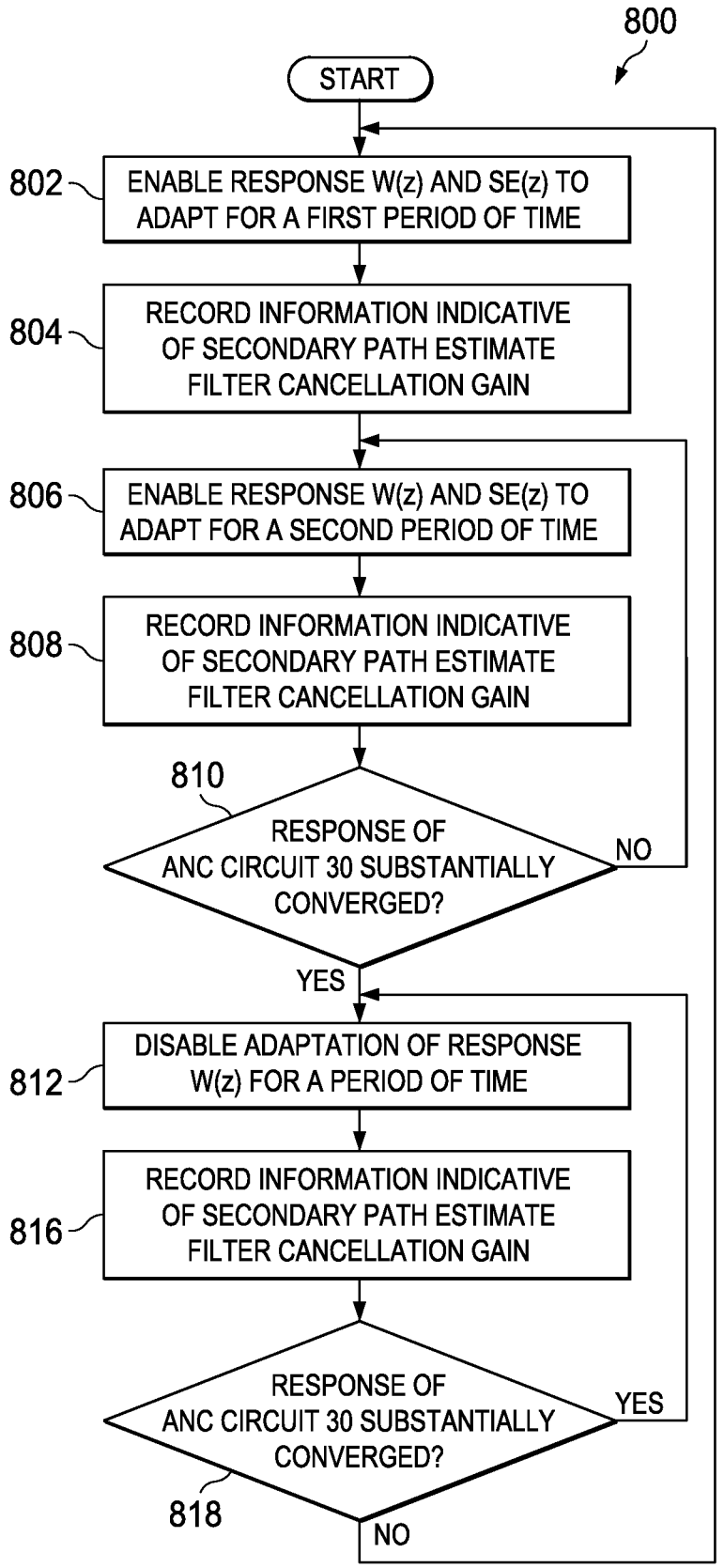
FIG. 8 is a flow chart of an example method for selectively enabling and disabling adaptation of an ANC circuit based on monitoring of a secondary path estimate filter cancellation gain of the ANC circuit, in accordance with embodiments of the present disclosure.

FIG. 8 is a flow chart of an example method 800 for selectively enabling and disabling adaptation of ANC circuit 30 based on monitoring of a secondary path estimate filter cancellation gain of ANC circuit 30, in accordance with embodiments of the present disclosure. According to some embodiments, method 800 begins at step 802. As noted above, teachings of the present disclosure are implemented in a variety of configurations of wireless telephone 10. As such, the preferred initialization point for method 800 and the order of the steps comprising method 800 may depend on the implementation chosen.

At step 802, controller 42 may enable responses W(z) and SE(z) to adapt for a first period of time. At step 804, at the end of the first period of time, controller 42 may record information indicative of the secondary path estimate filter cancellation gain (e.g., the response of the secondary path estimate filter cancellation gain as a function of frequency).

At step 806, controller 42 may continue to enable responses W(z) and SE(z) to adapt for a second period of time. At step 808, at the end of the second period of time, controller 42 may record information indicative of the secondary path estimate filter cancellation gain (e.g., the response of the secondary path estimate filter cancellation gain as a function of frequency).

At step 810, controller 42 may compare information indicative of the secondary path estimate filter cancellation gain at the end of the second period of time to the information indicative of the secondary path estimate filter cancellation gain recorded at the end of the first period of time to determine the degree of convergence of ANC circuit 30. If information indicative of the secondary path estimate filter cancellation gain at the end of the second period of time is within a predetermined threshold error of the information indicative of the secondary path estimate filter cancellation gain recorded at the end of the first period of time, controller 42 may determine that ANC circuit 30 is substantially converged, and may proceed to step 812. Otherwise, controller 42 may determine that ANC circuit 30 is not substantially converged, and may proceed again to step 806.

At step 812, in response to the determination that ANC circuit 30 is substantially converged, controller 42 may disable adaptation of response W(z) and power down one or more components associated with adaptation of response W(z) for an additional period of time. At step 816, at the end of the additional period of time, controller 42 may record information indicative of the secondary path estimate filter cancellation gain (e.g., the response of the secondary path estimate filter cancellation gain as a function of frequency).

At step 818, controller 42 may compare information indicative of the secondary path estimate filter cancellation gain at the end of the additional period of time to the information indicative of the secondary path estimate filter cancellation gain recorded at the end of the period of time in which adaptation of responses W(z) and SE(z) was most-recently enabled to determine the degree of convergence of ANC circuit 30. If information indicative of the secondary path estimate filter cancellation gain at the end of the additional period of time is within a predetermined threshold error of the information indicative of the secondary path estimate filter cancellation gain recorded at the end of the period of time in which adaptation of responses W(z) and SE(z) was most-recently enabled, controller 42 may determine that ANC circuit 30 is substantially converged, and may proceed to step 812. Otherwise, controller 42 may determine that ANC circuit 30 is not substantially converged, and may proceed again to step 802.

Although FIG. 8 discloses a particular number of steps to be taken with respect to method 800, method 800 may be executed with greater or fewer steps than those depicted in FIG. 8. In addition, although FIG. 8 discloses a certain order of steps to be taken with respect to method 800, the steps comprising method 800 may be completed in any suitable order.

Method 800 may be implemented using wireless telephone 10 or any other system operable to implement method 800. In certain embodiments, method 800 may be implemented partially or fully in software and/or firmware embodied in computer-readable media and executable by a controller.

In addition or alternatively to monitoring the secondary path estimate filter cancellation gain, controller 42 may be configured to determine the degree of convergence of the adaptive response by determining a cross-correlation between the source audio signal ds/ia and the playback corrected error. For example, controller 42 may determine the degree of convergence to be above the particular threshold if the cross-correlation is lesser than a threshold cross-correlation, and responsive to such determination, disable adaptation of the adaptive response (e.g., W(z) and/or SE(z)). Similarly, controller 42 may determine the degree of convergence to be below the particular threshold if the cross-correlation is greater than a threshold cross-correlation, and responsive to such determination, enable adaptation of the adaptive response.

Although FIGS. 2 and 3 depict a feedforward ANC system in which an anti-noise signal is generated from a filtered reference microphone signal, any other suitable ANC system employing an error microphone may be used in connection with the methods and systems disclosed herein. For example, in some embodiments, an ANC circuit employing feedback ANC, in which anti-noise is generated from a playback corrected error signal, may be used instead of or in addition to feedforward ANC, as depicted in FIGS. 2 and 3. An example of a feedback ANC circuit 30B is depicted in FIG. 9.

Figure 9:
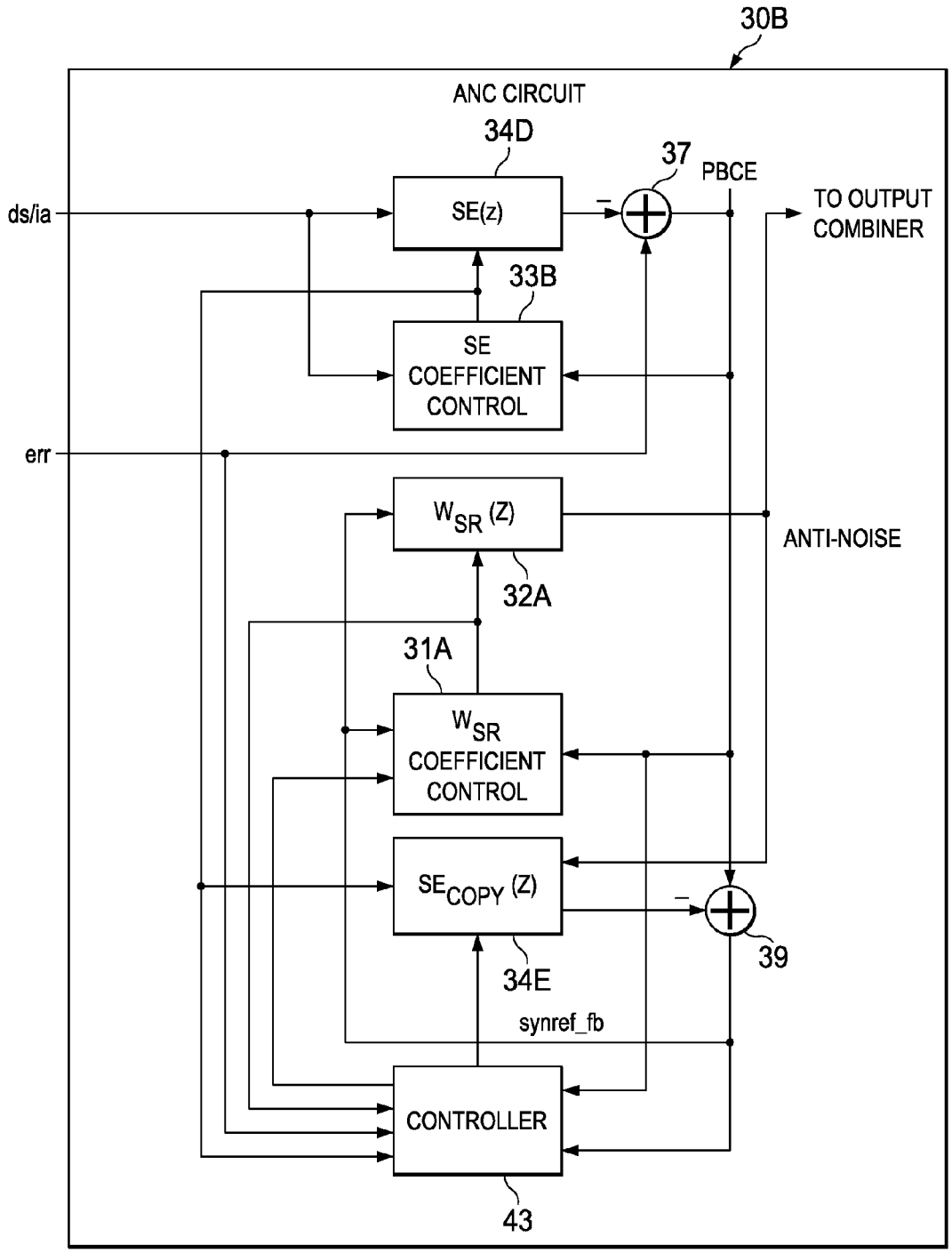
FIG. 9 is a block diagram depicting selected signal processing circuits and functional blocks within an example adaptive noise canceling (ANC) circuit of a coder-decoder (CODEC) integrated circuit of FIG. 2 which uses feedback filtering to generate an anti-noise signal, in accordance with embodiments of the present disclosure.

As shown in FIG. 9, feedback adaptive filter 32A may receive a synthesized reference feedback signal synref_fb and under ideal circumstances, may adapt its transfer function $W_{SR}(z)$ to generate the anti-noise signal, which may be provided to an output combiner that combines the anti-noise signal with the audio to be reproduced by the transducer, as exemplified by combiner 26 of FIG. 2. In some embodiments, selected components of ANC circuit 30 of FIG. 3 and ANC circuit 30B of FIG. 9 may be combined into a single ANC system, such that feedforward anti-noise signal component generated by ANC circuit 30 and the feedback anti-noise generated by ANC circuit 30B may combine to generate the anti-noise for the overall ANC system. Synthesized reference feedback signal synref_fb may be generated by combiner 39 based on a difference between a signal that includes the error microphone signal (e.g., the playback corrected error) and the anti-noise signal as shaped by a copy $SE_{COPY}(z)$ of an estimate of the response of path S(z) provided by filter 34E. The coefficients of feedback adaptive filter 32A may be controlled by a $W_{SR}$ coefficient control block 31A that uses a correlation of signals to determine the response of feedback adaptive filter 32A, which generally minimizes the error, in a least-mean squares sense, between those components of synthesized reference feedback signal synref_fb present in error microphone signal err. The signals compared by $W_{SR}$ coefficient control block 31A may be the synthesized reference feedback signal synref_fb and another signal that includes error microphone signal err. By minimizing the difference between the synthesized reference feedback signal synref_fb and error microphone signal err, feedback adaptive filter 32A may adapt to the desired response.

To implement the above, adaptive filter 34D may have coefficients controlled by SE coefficient control block 33B, which may compare downlink audio signal ds and/or internal audio signal ia and error microphone signal err after removal of the above-described filtered downlink audio signal ds and/or internal audio signal ia, that has been filtered by adaptive filter 34D to represent the expected downlink audio delivered to error microphone E, and which is removed from the output of adaptive filter 34D by a combiner 37 to generate the playback corrected error. SE coefficient control block 33B correlates the actual downlink speech signal ds and/or internal audio signal ia with the components of downlink audio signal ds and/or internal audio signal ia that are present in error microphone signal err. Adaptive filter 34D may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

Also as shown in FIG. 9, ANC circuit 30B may include a controller 43. As described in greater detail below, controller 43 may be configured to determine a degree of convergence of an adaptive response (e.g., response $W_{SR}(z)$ and/or response SE(z)) of ANC circuit 30B. Such determination may be made based on one or more signals associated with ANC circuit 30B, including without limitation the audio output signal, error microphone signal err, the playback corrected error, coefficients generated by $W_{SR}$ coefficient control block 31A, and coefficients generated by SE coefficient control block 33B. If the degree of convergence of the adaptive response is below a particular threshold, controller 43 may enable adaptation of the adaptive response. On the other hand, if the degree of convergence of the adaptive response is above a particular threshold, controller 43 may disable adaptation of the adaptive response. In some embodiments, controller 43 may disable adaptation of an adaptive response by disabling a coefficient control block (e.g., $W_{SR}$ coefficient control block 31A and/or SE coefficient control block 33B) associated with the adaptive response. In these and other embodiments, controller 43 may disable adaptation of an adaptive response (e.g., response $W_{SR}(z)$) by disabling filter 34E. In these and other embodiments, controller 43 may disable adaptation of an adaptive response (e.g., $W_{SR}(z)$) by disabling oversight detectors of ANC circuit 30B used to ensure stability in the adaptation of response W(z).

In some embodiments, controller 43 may, in a manner similar or analogous to that described in greater detail above with respect to FIGS. 4-6, be configured to determine a degree of convergence of an adaptive response (e.g., $W_{SR}(z)$ and/or SE(z)) by adapting the adaptive response for a first period of time, determining coefficients of an adaptive coefficient control block (e.g., $W_{SR}$ coefficient control block 31A and/or SE coefficient control block 33B) associated with the adaptive response at the end of the first period of time, adapting the adaptive response for a second period of time, determining coefficients of the adaptive coefficient control block at the end of the second period of time, and comparing the coefficients of the adaptive coefficient control block at the end of the first period of time to the coefficients of the adaptive coefficient control block at the end of the second period of time. For example, controller 43 may determine the degree of convergence to be above the particular threshold if the coefficients of the adaptive coefficient control block at the end of the second period of time are within a threshold error of the coefficients of the adaptive coefficient control block at the end of the first period of time, and responsive to such determination, disable adaptation of the adaptive response (e.g., $W_{SR}(z)$ and/or SE(z)). Similarly, controller 43 may determine the degree of convergence to be below the particular threshold if the coefficients of the adaptive coefficient control block at the end of the second period of time are not within the threshold error, and responsive to such determination, enable adaptation of the adaptive response. In addition, in some embodiments, controller 43 may, in a manner similar or analogous to that described in greater detail above with respect to FIGS. 7 and 8, be configured to determine a degree of convergence of an adaptive response (e.g., $W_{SR}(z)$ and/or SE(z)) by monitoring of an adaptive noise cancellation gain of ANC circuit 30B and/or a secondary path estimate filter cancellation gain of ANC circuit 30B.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

an output for providing an output signal to a transducer including both a source audio signal for playback to a listener and an anti-noise signal for countering the effect of ambient audio sounds in an acoustic output of the transducer;

an error microphone input for receiving an error microphone signal indicative of the output of the transducer and the ambient audio sounds at the transducer; and a processing circuit that implements:

an anti-noise generating filter having a response configured to generate the anti-noise signal based on the error microphone signal;

a secondary path estimate filter configured to model an electro-acoustic path of the source audio signal and having a response configured to generate a secondary path estimate from the source audio signal, wherein at least one of the response of the anti-noise generating filter and the response of the secondary path estimate filter is an adaptive response shaped by an adaptive coefficient control block;

the adaptive coefficient control block comprising at least one of:

a filter coefficient control block configured to shape the response of the anti-noise generating filter by adapting the response of the anti-noise generating filter to minimize the ambient audio sounds in the error microphone signal; and a secondary path estimate coefficient control block configured to shape the response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate; and a controller configured to:

determine a degree of convergence of the adaptive response;

enable adaptation of the adaptive response if the degree of convergence of the adaptive response is below a particular threshold; and if the degree of convergence of the adaptive response is above the particular threshold, repeatedly disable adaption of the adaptive response for a first period of time and enable adaptation of the adaptive response for a second period of time until the degree of convergence of the adaptive response is below the particular threshold.

2. The integrated circuit of claim 1, the controller further configured to determine the degree of convergence of the adaptive response by:

adapting the adaptive response for a first period of time, and determining coefficients of the adaptive coefficient control block at the end of the first period of time;

adapting the adaptive response for a second period of time, and determining coefficients of the adaptive coefficient control block at the end of the second period of time; and comparing the coefficients of the adaptive coefficient control block at the end of the first period of time to the coefficients of the adaptive coefficient control block at the end of the second period of time.

3. The integrated circuit of claim 2, the controller further configured to:

determine the degree of convergence to be above the particular threshold if the coefficients of the adaptive coefficient control block at the end of the second period of time are within a threshold error of the coefficients of the adaptive coefficient control block at the end of the first period of time; and determine the degree of convergence to be below the particular threshold if the coefficients of the adaptive coefficient control block at the end of the second period of time are not within the threshold error.

4. The integrated circuit of claim 1, the controller further configured to determine the degree of convergence of the adaptive response by:

determining an adaptive noise cancellation gain at a first time, wherein the adaptive noise cancellation gain is defined as a synthesized reference microphone signal divided by the playback corrected error, and wherein the synthesized reference microphone signal is based on a difference between the playback corrected error and the output signal;

determining the adaptive noise cancellation gain at a second time; and comparing the adaptive noise cancellation gain at the first time to the adaptive noise cancellation gain at the second time.

5. The integrated circuit of claim 4, the controller further configured to:

determine the degree of convergence to be above the particular threshold if the adaptive noise cancellation gain at the second time is within a threshold error of the adaptive noise cancellation gain at the first time; and determine the degree of convergence to be below the particular threshold if the adaptive noise cancellation gain at the end of the second time is not within the threshold error.

6. The integrated circuit of claim 1, wherein the adaptive response comprises the response of the secondary path estimate filter and wherein the controller is further configured to determine the degree of convergence of the adaptive response by:

adapting the adaptive response for a first period of time, and determining a secondary path estimate filter cancellation gain at the end of the first period of time, wherein the secondary path estimate filter cancellation gain is defined as the playback corrected error divided by the error microphone signal;

adapting the adaptive response for a second period of time, and determining the secondary path estimate filter cancellation gain at the end of the second period of time; and comparing the secondary path estimate filter cancellation gain at the end of the first period of time to the secondary path estimate filter cancellation gain at the end of the second period of time.

7. The integrated circuit of claim 6, the controller further configured to:

determine the degree of convergence to be above the particular threshold if the secondary path estimate filter cancellation gain at the end of the second period of time is within a threshold error of the secondary path estimate filter cancellation gain at the end of the first period of time; and determine the degree of convergence to be below the particular threshold if the secondary path estimate filter cancellation gain at the end of the second period of time is not within the threshold error.

8. The integrated circuit of claim 1, wherein the anti-noise generating filter comprises a feedback filter having a response that generates the anti-noise signal from a synthesized reference feedback signal, the synthesized reference feedback signal based on a difference between the error microphone signal and the anti-noise signal.

9. The integrated circuit of claim 8, wherein the filter coefficient control block comprises a feedback coefficient control block that shapes the response of the feedback filter in conformity with the error microphone signal and the synthesized reference feedback signal by adapting the response of the feedback filter to minimize the ambient audio sounds in the error microphone signal.

10. The integrated circuit of claim 1, further comprising a reference microphone input for receiving a reference microphone signal indicative of the ambient audio sounds, and wherein the anti-noise generating filter comprises a feedforward filter having a response configured to generate the anti-noise signal from the reference microphone signal.

11. The integrated circuit of claim 10, wherein the filter coefficient control block comprises a feedforward coefficient control block that shapes the response of the feedforward filter in conformity with the error microphone signal and the reference microphone signal by adapting the response of the feedforward filter to minimize the ambient audio sounds in the error microphone signal.

12. The integrated circuit of claim 10, wherein the controller is further configured to determine the degree of convergence of the adaptive response by determining a cross-correlation between the reference microphone signal and the playback corrected error.

13. The integrated circuit of claim 12, wherein the controller is further configured to:

determine the degree of convergence to be above the particular threshold if the cross-correlation is lesser than a threshold cross-correlation; and determine the degree of convergence to be below the particular threshold if the cross-correlation is greater than a threshold cross-correlation.

14. The integrated circuit of claim 1, wherein the controller is further configured to determine the degree of convergence of the adaptive response by determining a cross-correlation between the source audio signal and the playback corrected error.

15. The integrated circuit of claim 14, wherein the controller is further configured to:

determine the degree of convergence to be above the particular threshold if the cross-correlation is lesser than a threshold cross-correlation; and determine the degree of convergence to be below the particular threshold if the cross-correlation is greater than a threshold cross-correlation.

16. The integrated circuit of claim 1, wherein the controller is further configured to disable adaptation of the adaptive response by disabling the adaptive coefficient control block.

17. The integrated circuit of claim 1, wherein:

the integrated circuit comprises one or more copies of the secondary path estimate filter; and the controller further is configured to disable adaptation of the adaptive response by disabling the one or more copies of the secondary path estimate filter.

18. A method for canceling ambient audio sounds in the proximity of a transducer of a personal audio device, the method comprising:

receiving an error microphone signal indicative of an acoustic output of the transducer and the ambient audio sounds at the transducer;

adaptively generating an anti-noise signal to reduce the presence of the ambient audio sounds by adapting an adaptive response of an adaptive noise cancellation system to minimize the ambient audio sounds at the acoustic output of the transducer, wherein adaptively generating the anti-noise signal comprises:

generating the anti-noise signal based on at least the error microphone signal with an anti-noise generating filter;

generating a secondary path estimate from a source audio signal with a secondary path estimate filter for modeling an electro-acoustic path of a source audio signal; and at least one of:

adaptively generating the anti-noise signal by adapting the response of the anti-noise generating filter to minimize the ambient audio sounds in the error microphone signal, wherein the adaptive response comprises the response of the anti-noise generating filter; and adaptively generating the secondary path estimate by shaping a response of the secondary path estimate filter in conformity with the source audio signal and a playback corrected error by adapting the response of the secondary path estimate filter to minimize the playback corrected error, wherein the playback corrected error is based on a difference between the error microphone signal and the secondary path estimate, wherein the adaptive response comprises the response of the secondary path estimate filter;

combining the anti-noise signal with a source audio signal to generate an output signal provided to the transducer;

determining a degree of convergence of the adaptive response;

enabling adaptation of the adaptive response if the degree of convergence of the adaptive response is below a particular threshold; and if the degree of convergence of the adaptive response is above the particular threshold, repeatedly disabling adaption of the adaptive response for a first period of time and enabling adaptation of the adaptive response for a second period of time until the degree of convergence of the adaptive response is below the particular threshold.

19. The method of claim 18, wherein determining the degree of convergence of the adaptive response comprises:

adapting the adaptive response for a first period of time, and determining coefficients of an adaptive coefficient control block for controlling the adaptive response at the end of the first period of time;

adapting the adaptive response for a second period of time, and determining coefficients of the adaptive coefficient control block at the end of the second period of time; and comparing the coefficients of the adaptive coefficient control block at the end of the first period of time to the coefficients of the adaptive coefficient control block at the end of the second period of time.

20. The method of claim 19, further comprising:

determining the degree of convergence to be above the particular threshold if the coefficients of the adaptive coefficient control block at the end of the second period of time are within a threshold error of the coefficients of the adaptive coefficient control block at the end of the first period of time; and determining the degree of convergence to be below the particular threshold if the coefficients of the adaptive coefficient control block at the end of the second period of time are not within the threshold error.

21. The method of claim 20, wherein determining the degree of convergence of the adaptive response comprises:

determining an adaptive noise cancellation gain at a first time, wherein the adaptive noise cancellation gain is defined as a synthesized reference microphone signal divided by the playback corrected error, and wherein the synthesized reference microphone signal is based on a difference between the playback corrected error and the output signal;

determining the adaptive noise cancellation gain at a second time; and comparing the adaptive noise cancellation gain at the first time to the adaptive noise cancellation gain at the second time.

22. The method of claim 21, further comprising:

determining the degree of convergence to be above the particular threshold if the adaptive noise cancellation gain at the second time is within a threshold error of the adaptive noise cancellation gain at the first time; and determining the degree of convergence to be below the particular threshold if the adaptive noise cancellation gain at the end of the second time is not within the threshold error.

23. The method of claim 22, wherein the adaptive response comprises the response of the secondary path estimate filter and wherein determining the degree of convergence of the response comprises:

adapting the adaptive response for a first period of time, and determining a secondary path estimate filter cancellation gain at the end of the first period of time, wherein the secondary path estimate filter cancellation gain is defined as the playback corrected error divided by the error microphone signal;

adapting the adaptive response for second period of time, and determining the secondary path estimate filter cancellation gain the end of the second period of time; and comparing the secondary path estimate filter cancellation gain at the end of the first period of time to the secondary path estimate filter cancellation gain at the end of the second period of time.

24. The method of claim 23, further comprising:

determining the degree of convergence to be above the particular threshold if the secondary path estimate filter cancellation gain at the end of the second period of time is within a threshold error of the secondary path estimate filter cancellation gain at the end of the first period of time; and determining the degree of convergence to be below the particular threshold if the secondary path estimate filter cancellation gain at the end of the second period of time is not within the threshold error.

25. The method of claim 18, wherein the anti-noise generating filter comprises a feedback filter having a response that generates the anti-noise signal from a synthesized reference feedback signal, the synthesized reference feedback signal based on a difference between the error microphone signal and the anti-noise signal.

26. The method of claim 19, wherein the adaptive coefficient control block comprises a feedback coefficient control block that shapes the response of the feedback filter in conformity with the error microphone signal and the synthesized reference feedback signal by adapting the response of the feedback filter to minimize the ambient audio sounds in the error microphone signal.

27. The method of claim 18, further comprising receiving a reference microphone signal indicative of the ambient audio sounds; and wherein the anti-noise generating filter comprises a feedforward filter having a response that generates the anti-noise signal from the reference microphone signal.

28. The method of claim 27, further comprising using a feedforward coefficient control block to shape the response of the feedforward filter in conformity with the error microphone signal and the reference microphone signal by adapting the response of the feedforward filter to minimize the ambient audio sounds in the error microphone signal.

29. The method of claim 27, further comprising determining the degree of convergence of the adaptive response by determining a cross-correlation between the reference microphone signal and the playback corrected error.

30. The method of claim 29, further comprising:

determining the degree of convergence to be above the particular threshold if the cross-correlation is lesser than a threshold cross-correlation; and determining the degree of convergence to be below the particular threshold if the cross-correlation is greater than a threshold cross-correlation.

31. The method of claim 18, further comprising determining the degree of convergence of the adaptive response by determining a cross-correlation between the source audio signal and the playback corrected error.

32. The method of claim 31, further comprising:

determining the degree of convergence to be above the particular threshold if the cross-correlation is lesser than a threshold cross-correlation; and determining the degree of convergence to be below the particular threshold if the cross-correlation is greater than a threshold cross-correlation.

33. The method of claim 32, further comprising disabling adaptation of the adaptive response by disabling an adaptive coefficient control block for controlling the adaptive response.

34. The method of claim 18, further comprising disabling adaptation of the adaptive response by disabling one or more copies of the secondary path estimate filter.

35. A personal audio device comprising:

a transducer for reproducing an output signal including both a source audio signal for playback to a listener and an anti-noise signal for countering the effects of ambient audio sounds in an acoustic output of the transducer;

an error microphone for generating an error microphone signal indicative of the output of the transducer and the ambient audio sounds at the transducer; and a processing circuit that implements:

an anti-noise generating filter having a response that generates the anti-noise signal based on the error microphone signal;

a secondary path estimate filter configured to model an electro-acoustic path of the source audio signal and having a response that generates a secondary path estimate from the source audio signal, wherein at least one of the response of the anti-noise generating filter and the response of the secondary path estimate filter is an adaptive response shaped by an adaptive coefficient control block;

the adaptive coefficient control block comprising at least one of:

a filter coefficient control block that shapes the response of the anti-noise generating filter by adapting the response of the anti-noise generating filter to minimize the ambient audio sounds in the error microphone signal; and a secondary path estimate coefficient control block that shapes the response of the secondary path estimate filter in conformity with the source audio signal and a playback corrected error by adapting the response of the secondary path estimate filter to minimize the playback corrected error; wherein the playback corrected error is based on a difference between the error microphone signal and the secondary path estimate; and a controller configured to:

determine a degree of convergence of the adaptive response;

enable adaptation of the adaptive response if the degree of convergence of the adaptive response is below a particular threshold; and if the degree of convergence of the adaptive response is above the particular threshold, repeatedly disable adaption of the adaptive response for a first period of time and enable adaptation of the adaptive response for a second period of time until the degree of convergence of the adaptive response is below the particular threshold.

36. An integrated circuit for implementing at least a portion of a personal audio device, comprising a controller configured to:

determine a degree of convergence of an adaptive response of an adaptive filter in an adaptive noise cancellation system;

enable adaptation of the adaptive response if the degree of convergence of the adaptive response is below a particular threshold; and if the degree of convergence of the adaptive response is above the particular threshold, repeatedly disable adaption of the adaptive response for a first period of time and enable adaptation of the adaptive response for a second period of time, while continuing to apply the adaptive response to generate an anti-noise signal, until the degree of convergence of the adaptive response is below the particular threshold.

37. The integrated circuit of claim 36, wherein the adaptive filter comprises a secondary path estimate filter configured to model an electro-acoustic path of a source audio signal and having a response that generates a secondary path estimate from the source audio signal.

38. The integrated circuit of claim 36, wherein the adaptive filter comprises an anti-noise generating filter having a response that generates an anti-noise signal based on an error microphone signal indicative of an output of a transducer and the ambient audio sounds at the transducer.

39. The integrated circuit of claim 38, wherein the anti-noise generating filter comprises a feedback filter having a response that generates the anti-noise signal from a synthesized reference feedback signal, the synthesized reference feedback signal based on a difference between the error microphone signal and the anti-noise signal.

40. The integrated circuit of claim 36, wherein the anti-noise generating filter comprises a feedforward filter having a response that generates the anti-noise signal from a reference microphone signal indicative of ambient audio sounds.

* * * * *